US010711552B2

(12) United States Patent
Wilson et al.

(10) Patent No.: US 10,711,552 B2
(45) Date of Patent: Jul. 14, 2020

(54) TUBULAR CUTTING ASSEMBLIES

(71) Applicants: Paul James Wilson, Cypress, TX (US); Robert Bradley Cook, Mandeville, LA (US); Daniel Teen, Mandeville, LA (US); Glenn Mitchel Walls, Madisonville, TX (US)

(72) Inventors: Paul James Wilson, Cypress, TX (US); Robert Bradley Cook, Mandeville, LA (US); Daniel Teen, Mandeville, LA (US); Glenn Mitchel Walls, Madisonville, TX (US)

( * ) Notice: Subject to any disclaimer, the term of this patent is extended or adjusted under 35 U.S.C. 154(b) by 0 days.

(21) Appl. No.: 16/188,269

(22) Filed: Nov. 12, 2018

(65) Prior Publication Data

US 2020/0149365 A1 May 14, 2020

(51) Int. Cl.

| | |
|---|---|
| ***E21B 29/00*** | (2006.01) |
| ***E21B 34/10*** | (2006.01) |
| *E21B 34/00* | (2006.01) |

(52) U.S. Cl.

CPC ..... *E21B 29/005* (2013.01); *E21B 34/10* (2013.01); *E21B 2034/005* (2013.01); *E21B 2034/007* (2013.01)

(58) Field of Classification Search

CPC ..... E21B 29/00

See application file for complete search history.

(56) References Cited

U.S. PATENT DOCUMENTS

| | | | | |
|---|---|---|---|---|
| 2,899,000 | A | 8/1959 | Medders et al. | |
| 4,809,793 | A | 3/1989 | Pittard | |
| 5,036,921 | A | 8/1991 | Hailey | |
| 5,090,480 | A | 2/1992 | Pittard | |
| 5,101,895 | A | 4/1992 | Gilbert | |
| 5,174,374 | A | 12/1992 | Hailey | |
| 5,201,817 | A | 4/1993 | Hailey | |
| 5,242,017 | A | 9/1993 | Hailey | |
| 5,265,675 | A | 11/1993 | Hailey | |
| 5,350,015 | A | 9/1994 | Hailey | |
| 5,385,205 | A | 1/1995 | Hailey | |
| 5,791,409 | A | 8/1998 | Hailey | |
| 5,899,268 | A | 5/1999 | Lynde | |
| 7,063,155 | B2 | 6/2006 | Ruttley | |
| 7,575,056 | B2 | 1/2009 | Fuhst et al. | |
| 8,540,035 | B2 | 9/2013 | Xu et al. | |
| 8,991,489 | B2 | 3/2015 | Redlinger et al. | |
| 2008/0236828 | A1* | 10/2008 | Fuhst | E21B 29/005 166/297 |
| 2011/0220357 | A1* | 9/2011 | Segura | E21B 29/002 166/298 |
| 2017/0030156 | A1 | 2/2017 | Churchill | |

FOREIGN PATENT DOCUMENTS

| | | |
|---|---|---|
| WO | WO2003101656 A1 | 11/2003 |

* cited by examiner

*Primary Examiner* — William D Hutton, Jr.
*Assistant Examiner* — Avi T Skaist
(74) *Attorney, Agent, or Firm* — Elliott & Polasek, PLLC; Douglas H. Elliott; Nathan Q. Huynh

(57) ABSTRACT

The disclosure herein includes a tubular cutting assembly for cutting a downhole tubular string, which tubular cutting assembly may include: a landing seat capable of being disposed on the downhole tubular string; and a tubular cutting assembly including: a landing mandrel capable of being coupled to the landing seat; a motor disposed below the landing mandrel; and a cutter assembly coupled to the motor.

20 Claims, 18 Drawing Sheets

TUBULAR CUTTING ASSEMBLIES

BACKGROUND

1. Field of Inventions

The field of this application and any resulting patent is tubular cutting assemblies.

2. Description of Related Art

Various tubular cutting assemblies and methods for cutting a downhole tubular string, have been proposed and utilized, including some of the methods and structures disclosed in some of the references appearing on the face of this application. However, those methods and structures lack the combination of steps and/or features of the methods and/or structures disclosed herein. Furthermore, it is contemplated that the methods and/or structures disclosed herein solve many of the problems that prior art methods and structures have failed to solve. Also, the methods and/or structures disclosed herein have benefits that would be surprising and unexpected to a hypothetical person of ordinary skill with knowledge of the prior art existing as of the filing date of this application.

SUMMARY

The disclosure herein includes a tubular cutting assembly, which tubular cutting assembly may include: a landing seat capable of being disposed on the downhole tubular string; and a tubular cutting assembly including: a landing mandrel capable of being coupled to the landing seat; a motor disposed below the landing mandrel; and a cutter assembly coupled to the motor.

The disclosure herein includes a method of cutting a downhole tubular string, which method may include: pumping a tubular cutting assembly in the downhole tubular string; coupling the tubular cutting assembly to a landing seat disposed on the downhole tubular string; pumping fluid into the downhole tubular string at an actuation flow rate; pushing a piston against a portion of a blade; abutting a cutting end of the blade against an inner surface of the downhole tubular string; and rotating the blade around a central axis of the downhole tubular string.

DETAILED DESCRIPTION

1. Introduction

Figure 1A:
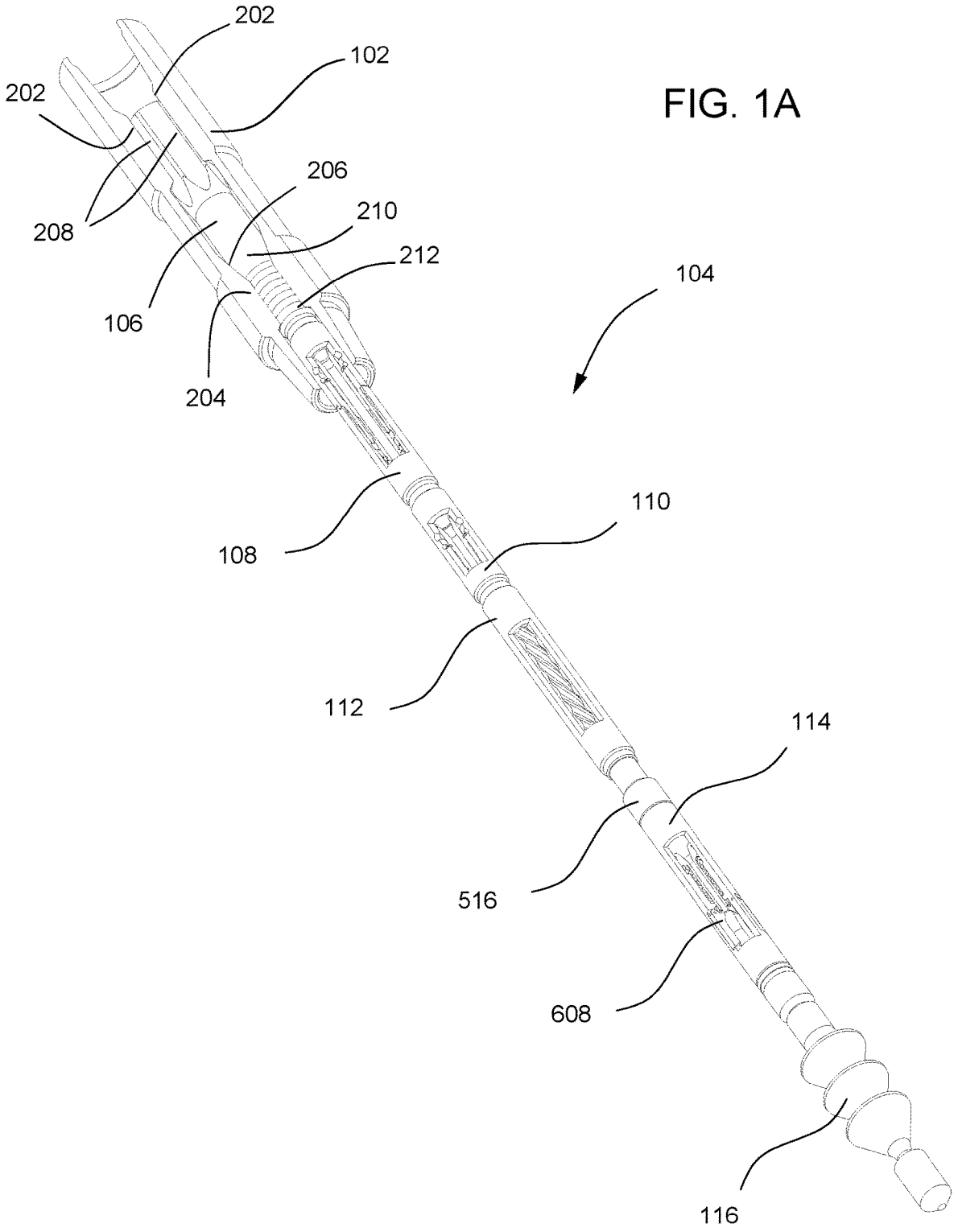
FIG. 1A illustrates a perspective view of a tubular cutting assembly including a landing seat and a tubular cutting assembly coupled to the landing seat and having blades retracted.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "aligning" as used herein is a verb that means manufacturing, forming, adjusting, or arranging one or more physical objects into a particular position. After any aligning takes place, the objects may be fully or partially "aligned." Aligning preferably involves arranging a structure or surface of a structure in linear relation to another structure or surface; for example, such that their borders or perimeters may share a set of parallel tangential lines. In certain instances, the aligned borders or perimeters may share a similar profile. Additionally, apertures may be aligned, such that a structure or portion of a structure may be extended into and/or through the apertures.

The term "aperture" as used herein is defined as any opening in a solid object or structure, e.g., seat, landing mandrel, lock sleeve, bypass sleeve, disconnect assembly, circulating valve assembly, check valve assembly, motor, cutter assembly, collar, piston, housing, or tubular. For example, an aperture may be an opening that begins on one side of a solid object and ends on the other side of the object. An aperture may alternatively be an opening that does not pass entirely through an object, but only partially passes through, e.g., as a groove. An aperture can be an opening in an object that is completely circumscribed, defined, or delimited by the object itself. Alternatively, an aperture can be an opening formed when one object is combined with one or more other objects or structures. An aperture may receive an object, e.g., downhole cutting assembly, lock sleeve, blade, piston, or wiper plug. For example, a piston may be received in an aperture of a collar of a housing of a cutter assembly. Additionally, a seal portion of a landing mandrel may be received within an aperture of a landing seat.

The term "assembly" as used herein is defined as any set of components that have been fully or partially assembled together. A group of assemblies may be coupled to form a solid housing having an inner surface and an outer surface.

The term "bearing assembly" as used herein is defined as an assembly capable of supporting a rotor as it is rotated. A bearing assembly may be coupled to an inner surface of a stator. A rotor may have an upper portion rotatably coupled to a bearing assembly. A bearing assembly may be disposed concentrically around a rotor. A bearing assembly may include a bushing, e.g., sleeve. Examples of a bearing assembly may include an axial support bearing, a journal bearing, and/or a thrust bearing. A bearing assembly may be disposed at each end of a rotor.

The term "blade" as used herein is defined as a structure having a sharp end, edge or tip, e.g., for cutting a downhole tubular string. Cutting may include shearing, gouging, or scraping a downhole tubular string. A blade maybe disposed in a window of a housing of a cutter assembly. A blade may include an end pivotably coupled to a housing of a cutter assembly. A blade may have a portion capable of being abutted against a piston. A blade may include an end, edge, or tip having tungsten carbide. A blade may have and end, edge, or tip having material that include tungsten, molybdenum, chromium, vanadium, cobalt, and/or carbon.

The term "check valve assembly" as used herein is defined as an assembly providing a flow path for fluid, e.g. mud, lubricant, cement, and/or cleaning agents, in one direction. A check valve assembly may include a first housing, a second housing, and one or more flapper assemblies. A check valve assembly may have a housing constructed from multiple housings. A check valve assembly may include a flapper biased in a closed position. A check valve assembly include a flapper that is capable of biased away from a collar to an open position. A dart may be passed through a check valve assembly.

The term "cutter assembly" as used herein is defined as an assembly for cutting a downhole tubular string. A cutter assembly may include a housing, a piston, a coil, and one or more blades. A cutter may include blades pivotably coupled to a housing.

The term "circulating valve assembly" as used herein is defined as an assembly providing alternate flow paths for fluid, e.g. mud, lubricant, cement, and/or cleaning agents.

The term "coupled" as used herein is defined as directly or indirectly connected or attached. A first object may be coupled to a second object such that the first object is positioned at a specific location and orientation with respect to the second object. For example, a motor may be coupled to a cutter assembly. A first object may be either permanently, removably, slidably, shearably, threadably, pivotably, anti-rotatably, and/or fixedly coupled to a second object. Two objects may be removably coupled to each other via shear pins, threads, tape, latches, hooks, fasteners, locks, male and female connectors, clips, clamps, knots, and/or surface-to-surface contact. For example, a landing seat and a landing mandrel may be removably coupled to each other such that the landing mandrel may then be uncoupled and removed from the landing seat. Two objects may be slidably coupled together, where an inner aperture of one object is capable of receiving a second object. For example, a piston extended through a collar of a housing of a cutter assembly may be slidably coupled to the collar. Two objects may be shearably coupled together, e.g., where a pin is extended through the objects and force applied to one object may break or shear the pin. For example, a pin may be extended through a lock sleeve and a housing of a disconnect assembly, and force applied to the lock sleeve may be transferred to the pin to cause the pin to be sheared or broken. Additionally, two objects may be capable of being threadably coupled, e.g., where a threaded outer surface of one object is capable of being engaged with or to a threaded inner surface of another object. Threadably coupled objects may be removably coupled. Accordingly, a motor may be threadably coupled to a landing mandrel where a threaded inner surface, e.g., box threads or female threads, of the landing mandrel may be engaged with a threaded outer surface, e.g., pin threads or male threads, of the motor. Two objects may be anti-rotatably coupled together, e.g., where the first object may be inhibited from being rotated relative to the second object. For example, a landing mandrel may be anti-rotatably coupled to a landing seat where the landing seat, in some cases, may not be rotated relative to the landing mandrel. Anti-rotatably coupled objects may still be moved axially relative to each other. Two objects may be fixedly coupled together, e.g., where the first object may be inhibited from being rotated and/or moved axially relative to the second object. For example, a landing mandrel may be fixedly coupled to a landing seat where the landing mandrel, in some cases, may neither be rotated nor moved axially relative to each other.

The term "cylindrical" as used herein is defined as shaped like a cylinder, e.g., having straight parallel sides and a circular or oval or elliptical cross-section. Examples of a cylindrical structure or object may include a landing seat, a landing mandrel, a lock sleeve, a bypass sleeve, a disconnect assembly, a circulating valve assembly, a check valve assembly, a motor, a cutter assembly, a collar, a piston, a housing, a mandrel, and a tubular. A cylindrical object may be completely or partially shaped like a cylinder. For example, a cylindrical object may have an aperture that is extended through the entire length of the housing to form a hollow cylinder capable of permitting another object, e.g., landing mandrel, housing, piston, wiper plug, or dart, to be extended or passed through. Alternatively, a solid cylindrical object may have an inner surface or outer surface having a diameter that changes abruptly. A cylindrical object may have and inner or outer surface having a diameter that changes abruptly to form a collar, e.g., radial face, rim, or lip. A cylindrical object may have a collar extending toward or away from the central axis line of the object. A cylindrical object may have a collar disposed on an inner surface. A cylindrical object may have a collar disposed on an outer surface. Additionally, a cylindrical object, may have a collar that is tapered or radiused.

The term "dart" as used herein is defined as a structure for landing onto another structure, e.g., seat, lock sleeve, or bypass sleeve. Examples of a dart may include a ball, a plug, and a wedge. A dart may have a tapered profile. A dart may be elongated. A dart may inhibit fluid flow.

The term "disconnect assembly" as used herein is defined as a structure having portions removably coupled to each other. A disconnect assembly may have an upper housing and a lower housing. An upper housing of a disconnect assembly may include a first castellation face. A lower housing of a disconnect assembly may include a second castellation face that is capable of meshing with a first castellation face of an upper housing of the disconnect assembly.

The terms "first" and "second" as used herein merely differentiate two or more things or actions, and do not signify anything else, including order of importance, sequence, etc.

The term "flow path" as used herein is defined as a conduit or space through which fluid is capable of being flowed. A flow path may be disposed within an object, e.g., seat, landing mandrel, lock sleeve, bypass sleeve, disconnect assembly, circulating valve assembly, check valve assembly, motor, cutter assembly, bearing assembly, thrust assembly, collar, piston, housing, and/or tubular. A flow path may extend uninterrupted through ends of an object, e.g., a landing mandrel, a disconnect assembly, a circulating valve assembly, a motor, and/or a cutter assembly. A flow path may be formed by a groove disposed on an object. A flow path may be a groove disposed in an outer surface of an object. A flow path may be formed by the inner surface of an object. A flow path may be formed by the inner surface of a group of coupled objects, e.g., seat, landing mandrel, lock sleeve, bypass sleeve, disconnect assembly, circulating valve assembly, check valve assembly, motor, cutter assembly, bearing assembly, or thrust assembly, collar, piston, housing, and/or tubular. A flow path may be formed from two or more connected flow paths.

The term "flow rate" as used herein is defined as the volume of material or fluid that passes per unit of time. Volume may be measured in gallons or liters. Time may be measured in seconds, minutes, or hours. A flow rate of a pumped fluid may be measured at the surface. A flow rate of a pumped fluid may be measured before the fluid is pumped into a downhole tubular string. A flow rate of a pumped fluid may be measured at a station or a pump that pumped the fluid. A "pump down fluid flow rate" may range from as low as 30, 35, 40, 45, 50, 55 gallons per minute to as high as 60, 70, 80, 90, 120, 160 gallons per minute or higher. An "actuation fluid flow rate" may range from as low as 55, 60, 65 gallons per minute to as high as 120, 140, 160, 200, 250 gallons per minute or higher.

The term "fluid" as used herein is defined as material that is capable of being flowed. A fluid may be a liquid or a gas. Examples of a fluid may include hydrocarbon, water, drilling fluid, drilling mud, cement, lubricant, cleaning fluid, and motor oil. A fluid may include material, e.g., hydrocarbon, water, compounds, and/or elements originating from underground rock formation. A fluid can be a mixture of two or more fluids. A fluid may absorb heat. A fluid may have properties such as viscosity, anti-foaming, thermal stability, thermal conductivity, and thermal capacity. Fluid in a downhole tubular string used in driving a motor, e.g., motor, may be call "mud." A fluid may be water-based, oil-based, synthetic, or a combination of viscous materials and solid materials.

The term "fluid port" as used herein is defined as an aperture in a structure for providing ingress and/or egress of fluid therethrough. A fluid port may be disposed in a landing seat, a landing mandrel, a lock sleeve, a bypass sleeve, a disconnect assembly, a circulating valve assembly, a check valve assembly, a motor, a cutter assembly, a bearing assembly, a thrust assembly, a collar, a piston, a housing, and/or a tubular. A fluid port may be disposed in a tubular, e.g., housing or sleeve of a disconnect assembly, circulating valve assembly, or cutter assembly. A fluid port may extend through a shaft assembly. A fluid port may extend in a direction perpendicular to the central axis of a tubular. Fluid ports may be disposed symmetrically around a tubular. In some cases, fluid ports may not necessarily be precisely the same circumferential distance apart. The preferable circumferential distance between each fluid port in a tubular may be approximately 360 degrees divided by the number of fluid ports.

The term "housing" as used herein is defined as a structure, preferably a cylindrical structure, configured to be filled with fluid, e.g., hydrocarbon, water, drilling fluid, cement, lubricant, and/or cleaning fluid. A housing may have a central aperture extending therethrough. A housing may have one or more threaded ends for coupling with another housing. Multiple housings may be coupled axially to form a longer housing. A housing, e.g., of a motor, may include a stator and one or more housings. A housing may receive another object or structure therein. A housing and an object or structured disposed therein may be concentric.

The term "landing mandrel" as used herein is defined as a structure for landing on a landing seat. An outer surface of a landing mandrel may have male socket surfaces disposed thereon. Male socket surfaces of a landing mandrel may be aligned with socket surfaces of an inner surface of a landing seat. A landing mandrel may be anti-rotatably or fixedly coupled to a landing seat. Thus, a landing mandrel, in some case, cannot be rotated relative to a landing seat.

The term "lock" as used herein is defined as a structure for coupling two or more objects together. For example, a lock may be used to couple a landing mandrel to a landing seat. Types of locks may include a lug, a steel ball, a slip, a dog, a collect, a ring, and a sleeve. A lock may inhibit movement of a first object in one or more directions, e.g., radially and/or axially. A lock may be disposed in grooves or apertures of one or more objects, e.g., landing mandrel and/or landing seat. A lock may be disposed circumferentially on an object, e.g., landing mandrel and/or landing seat. A lock may be a disposed on an outer surface of an object, e.g., landing mandrel. A lock may be a ring disposed on an inner surface of an object, e.g., landing seat. A lock may have a surface abutted against an object. A lock may have teeth. A lock may have teeth capable of being coupled to teeth or threads disposed on an object, e.g., landing seat. A lock may have a first portion abutted against a surface of a first object and a second portion abutted against a surface of a second object. For example, a lock may have a first portion abutted against a surface of a landing mandrel and a second portion abutted against a surface of a landing seat. A lock may have outer socket surfaces capable of being aligned with inner socket surfaces of a landing seat. A lock may have outer socket surfaces aligned with inner socket surfaces of a landing seat.

The term "motor" as used herein is defined as an assembly for driving movement, of an object, e.g., cutter assembly, a housing, a piston, and/or a blade. Movement of an object may include rotation of the object on a central axis. Additionally, movement may include radial displacement or axial displacement of an object relative to another object. Types of motor may include a mud motor or a turbine motor. A "mud motor" may be a progressive cavity positive displacement pump motor having a portion, e.g., drive shaft and/or rotor, capable of being rotated. A mud motor may include a stator, a rotor, and bearing assemblies. A mud motor may include a stator, a rotor, and a drive shaft assembly. A "turbine motor" may be a progressive cavity positive displacement pump motor having one or more rotatable portions, e.g., drive shaft and/or rotors, having fins or blades extending from each rotatable portion. Fluid may flow across vanes, e.g., fins or blades, of a turbine motor. A motor may include a drive shaft assembly capable of being coupled to a cutter assembly. The inner surface of a motor may define an aperture extending through ends of a motor.

The term "orthogonal" as used herein is defined as at an angle ranging from 85° or 88 to 92° or 95°. Two structures that are orthogonal to each other may be perpendicular and/or tangential to each other.

The term "pressure" as used herein is defined as force per unit area. Pressure may be exerted against a surface of an object, e.g., rotor, piston head, seat, and/or dart, from the flow of fluid across the surface.

The term "providing" as used herein is defined as making available, furnishing, supplying, equipping, or causing to be placed in position.

The term "pin" as used herein is defined as structure capable of being received in an aperture or groove of another structure, e.g., for coupling two objects or inhibiting movement of an object. A pin may also be referred to as a lug. A pin may have a tapered end. A pin may be broken via dissolving or breaking, e.g., shearing or snapping. A pin may be broken upon application of threshold force against the pin. A pin may be used to shearably couple a lock sleeve to a housing of a disconnect assembly. A pin may be used to shearably couple a bypass sleeve to a housing of a circulating valve assembly. A pin be disposed in an inner wall of a housing of a cutter assembly to inhibit upward movement of a piston.

The term "piston" as used herein is defined as a structure capable of being moved by fluid pressure applied thereto. A piston may have a head and a stem. A piston may have an aperture disposed therethrough. A piston may be solid. A piston may be slid relative to a housing by application of fluid pressure against a surface of the piston. A piston may have an insert disposed within a piston head of the piston.

The term "pressure" as used herein is defined as force per unit area. Pressure may be exerted against a surface of an object, e.g., rotor or piston head, from the flow of fluid across the surface.

The term "downhole cutting assembly" as used herein is defined as an assembly or structure for deployment within a tubular string, e.g., to cut the tubular string. A downhole cutting assembly may be coupled with a landing seat to form a tubular cutting assembly. A downhole cutting assembly may include a landing mandrel, a motor, and a cutter assembly. A downhole cutting assembly may include a disconnect assembly, a check valve assembly, and/or a bypass valve. A downhole cutting assembly may be deployed via freefall, wireline, slickline, coiled tubing, or a column of fluid.

The term "rotor" as used herein is defined as a cylindrical structure capable of rotating, e.g., rotating relative to a stator in response to fluid pressure. A rotor may have a helical portion. A rotor may have an outer surface having lobes thereon. A rotor may be coupled to a drive shaft assembly. A rotor may be coupled to one or more bearing assemblies.

The term "seat" as used herein is defined as a structure for receiving an object, e.g., landing mandrel or a dart, thereon. A landing seat may receive a landing mandrel or a dart. A landing seat may have an inner surface that defines an aperture disposed therethrough. A landing seat may have one or more socket surfaces disposed in an inner surface of the landing seat. A landing seat may have one or more socket surfaces capable being aligned with male socket surfaces of a landing mandrel. A landing mandrel may be anti-rotatably and/or fixedly coupled to a landing seat such that the landing mandrel, in some case, cannot be rotated relative to the landing seat. A landing seat may be threadably coupled to a downhole tubular or a tubular string, e.g., casing, drilling pipe, or liner hanger. A landing seat coupled to a downhole tubular or a tubular string may be "tripped" into a well. Multiple seats may be coupled a downhole tubular or tubular string. Each seat disposed above a lower seat on a downhole tubular or tubular string may an inner surface having a diameter larger than that of the lower seat.

The term "socket surfaces" as used herein is defined as connected surfaces having a polygonal cross-section. An example of a polygonal cross-section may be triangular, square, rectangular, pentagonal, hexagonal, or octagonal. Socket surfaces may have surfaces connected to form a polygonal shape, e.g., triangular, square, rectangular, pentagonal, hexagonal, or octagonal. Males socket surfaces may be disposed on an outer surface of a cylindrical structure, e.g., landing mandrel, sleeve, housing, cap, rod, or bolt. Female socket surfaces may be disposed on an inner surface of a cylindrical structure, e.g., landing seat, sleeve, housing, cap, rod, or bolt. Female socket surfaces of a landing seat are capable of being aligned with male socket surfaces of a landing mandrel. Female socket surfaces of a landing seat are capable of being abutted against male socket surfaces of a landing mandrel.

The term "stator" as used herein is defined as a housing of a rotor of a motor. A stator may be part of a motor. Preferably, a stator is a portion of a motor that remains fixed with respect to rotating parts, e.g., shaft, rotor, bearing assembly, and/or drive shaft assembly. A stator may have a central aperture. A stator may be coupled to a housing. A stator may have a helical portion. A stator may have an inner surface having lobes thereon.

The term "surface" as used herein is defined as any face of a structure. A surface may also refer to that flat or substantially flat area that is extended radially around a cylinder which may, for example, be part of a rotor or bearing assembly. A surface may also refer to that flat or substantially flat area that extend radially around a cylindrical structure or object which may, for example, be part of a landing seat, a landing mandrel, a lock sleeve, a bypass sleeve, a disconnect assembly, a circulating valve assembly, a check valve assembly, a motor, a cutter assembly, a collar, a piston, a housing, a mandrel, and/or a tubular. A surface may have irregular contours. A surface may be formed from coupled components, e.g. landing seat, a landing mandrel, lock sleeve, bypass sleeve, disconnect assembly, circulating valve assembly, check valve assembly, motor, cutter assembly, collar, piston, housing, mandrel, and/or tubular. Coupled components may form irregular surfaces. A plurality of surfaces may be connected to form a polygonal cross-section. An example of a polygonal cross-section may be triangular, square, rectangular, pentagonal, hexagonal, or octagonal. Socket surfaces may have socket surfaces connected to form a polygonal shape, e.g., triangular, square, rectangular, pentagonal, hexagonal, or octagonal. Socket surfaces may have curved walls connected to form a substantially polygonal shape, e.g., triangular, square, rectangular, pentagonal, hexagonal, or octagonal.

The term "tapered" as used herein is defined as becoming progressively smaller at one end. Structures that are tapered may have a profile that is beveled, frustoconical, and/or conical.

The term "threaded" as used herein is defined as having threads. Threads may include one or more helical protrusions or grooves on a surface of a cylindrical object. Each full rotation of a protrusion or groove around a threaded surface of the object is referred to herein as a single "thread." Threads may be disposed on any cylindrical structure or object including a landing seat, a landing mandrel, a lock sleeve, a bypass sleeve, a disconnect assembly, a circulating valve assembly, a check valve assembly, a motor, a cutter assembly, a collar, a piston, a housing, a mandrel, and a tubular. Threads formed on an inner surface of an object may be referred to as "box threads". Threads formed on an outer surface of an object, e.g., seat, sleeve, housing, seal, or tubular, may be referred to as "pin threads." A threaded assembly may include a "threaded portion" wherein a section of the threaded assembly includes threads, e.g., pin threads or box threads. A threaded portion may have a diameter sized to extend through an aperture of a sleeve, a housing, or a collar. In certain cases, a threaded portion of a first object may be removably coupled to a threaded portion of a second object.

The term "tubular" as used herein is defined as a structure having an inner surface and an outer surface. A tubular may have an aperture disposed therethrough. Preferably, a tubular is cylindrical. Examples of a tubular may include a landing seat, a landing mandrel, a lock sleeve, a bypass sleeve, a disconnect assembly, a circulating valve assembly, a check valve assembly, a motor, a cutter assembly, a collar, a piston, a housing, and a mandrel. However, any or all tubulars of an assembly may have polygonal cross-sections, e.g., triangular, rectangular, pentagonal, hexagonal, or octagonal.

The term "unitary" as used herein defined as having the nature, properties, or characteristics of a single unit. For example, a piston head and a piston stem that are individual parts of a piston may be unitary in the sense they are not separate but rather are formed from a single piece of material, e.g., plastic, carbon fiber, ceramic, or metal. Additionally, socket surfaces that are individual parts of a landing seat or a landing mandrel may be unitary in the sense they are not separate but rather are formed from a single piece of material, e.g., plastic, carbon fiber, ceramic, or metal.

The terms "upper," "lower," "top," "bottom" as used herein are relative terms describing the position of one object, thing, or point positioned in its intended useful position, relative to some other object, thing, or point also positioned in its intended useful position, when the objects, things, or points are compared to distance from the center of the earth. The term "upper" identifies any object or part of a particular object that is farther away from the center of the earth than some other object or part of that particular object, when the objects are positioned in their intended useful positions. The term "lower" identifies any object or part of a particular object that is closer to the center of the earth than some other object or part of that particular object, when the objects are positioned in their intended useful positions. For example, a landing mandrel, a disconnect assembly, a circulating valve assembly, motor, cutter assembly, housing, sleeve, and/or seat may each have an upper end and a lower end. Additionally, a cylindrical object, e.g., a landing mandrel, a disconnect assembly, a circulating valve assembly, motor, cutter assembly, housing, sleeve, and/or seat, may have an upper portion and a lower portion. The term "top" as used herein means in the highest position, e.g., farthest from the ground. The term "bottom" as used herein means in the lowest position, e.g., closest the ground. For example, a cylindrical object, e.g., a landing mandrel, a disconnect assembly, a circulating valve assembly, motor, cutter assembly, housing, sleeve, and/or seat, may have a top portion and a bottom portion.

3. Certain Specific Embodiments

The disclosure herein includes a tubular cutting assembly for cutting a downhole tubular string, which tubular cutting assembly may include: a landing mandrel; a motor disposed below the landing mandrel; and a cutter assembly coupled to the motor.

The disclosure herein includes a tubular cutting assembly for cutting a downhole tubular string, which tubular cutting assembly may include: a landing seat capable of being disposed on the downhole tubular string; and a tubular cutting assembly including: a landing mandrel capable of being coupled to the landing seat; a motor disposed below the landing mandrel; and a cutter assembly coupled to the motor.

The disclosure herein includes a method of cutting a downhole tubular string, which method may include: pumping a tubular cutting assembly in the downhole tubular string; coupling the tubular cutting assembly to a landing seat disposed on the downhole tubular string; pumping fluid into the downhole tubular string at an actuation flow rate; pushing a piston against a portion of a blade; abutting a cutting end of the blade against an inner surface of the downhole tubular string; and rotating the blade around a central axis of the downhole tubular string.

In any one of the methods or structures disclosed herein, the landing mandrel is capable of being fixedly coupled to the landing seat.

In any one of the methods or structures disclosed herein, the motor may be coupled to the landing mandrel.

In any one of the methods or structures disclosed herein, the tubular cutting assembly may further include a disconnect assembly may be coupled to the landing mandrel.

In any one of the methods or structures disclosed herein, the tubular cutting assembly may further include a disconnect assembly including: a first housing having an aperture;

a second housing removably coupled to the first housing, the second housing having a lock groove disposed in an inner surface the second housing; a locking sleeve slidably coupled to the first housing, the lock sleeve having a release groove; and a lug abutted against the lock sleeve and extended through the aperture of the first housing and into the lock groove of the second housing.

In any one of the methods or structures disclosed herein, the lug is capable of egress from the lock groove of the second housing and ingress into the release groove of the lock sleeve.

In any one of the methods or structures disclosed herein, the locking sleeve is capable of seating a dart.

In any one of the methods or structures disclosed herein, the first housing further include a bypass aperture, wherein the locking sleeve may obstruct the bypass aperture.

In any one of the methods or structures disclosed herein, the first housing further include a bypass aperture, wherein the locking sleeve is capable of being slid away from the bypass aperture.

In any one of the methods or structures disclosed herein, the tubular cutting assembly may further include a circulating valve assembly may be coupled to the landing mandrel.

In any one of the methods or structures disclosed herein, the tubular cutting assembly may further include a circulating valve assembly coupled to the motor.

In any one of the methods or structures disclosed herein, the tubular cutting assembly may further include a circulating valve assembly that includes: a housing having a bypass aperture disposed therein; a bypass sleeve slidably coupled to the housing.

In any one of the methods or structures disclosed herein, the bypass sleeve is capable of seating a dart.

In any one of the methods or structures disclosed herein, the bypass sleeve may obstruct the bypass aperture.

In any one of the methods or structures disclosed herein, the bypass sleeve is capable of being slid away from the bypass aperture.

In any one of the methods or structures disclosed herein, fluid in the tubular string may be capable of ingress, egress, or both, through the landing mandrel, the motor, and the cutter assembly.

In any one of the methods or structures disclosed herein, the landing seat may further include inner socket surfaces capable of being aligned with outer socket surfaces disposed on the landing mandrel.

In any one of the methods or structures disclosed herein, the landing mandrel may include: an outer surface; outer socket surfaces disposed on the outer surface, wherein the outer socket surfaces are capable of being aligned with inner socket surfaces disposed on the landing seat; and a seal disposed circumferentially on the outer surface.

In any one of the methods or structures disclosed herein, a seal may be disposed circumferentially on an outer surface of the landing mandrel, wherein the seal is capable of being sealingly abutted against an inner surface of the landing seat.

In any one of the methods or structures disclosed herein, a lock may be disposed on the landing mandrel.

In any one of the methods or structures disclosed herein, the lock has teeth that may be capable of being coupled to teeth disposed on the landing seat.

In any one of the methods or structures disclosed herein, the motor may further include: a stator; a rotor disposed in the stator; and a drive shaft assembly coupled to the rotor and coupled to the cutter assembly, the drive shaft assembly including: inlet fluid ports; and a central aperture in fluid communication with the inlet fluid ports.

Any one of the methods or structures disclosed herein the tubular cutting assembly may further include a wiper plug.

Any one of the methods or structures disclosed herein the tubular cutting assembly may further include a wiper plug coupled to the cutter assembly.

Any one of the methods or structures disclosed herein the tubular cutting assembly may further include a wiper plug may be coupled to the cutter assembly.

In any one of the methods or structures disclosed herein, the rotor may be rotatably coupled to the housing.

In any one of the methods or structures disclosed herein, the rotor may further include a universal coupling adapter.

In any one of the methods or structures disclosed herein, the rotor may further include a universal coupling adapter having U-joint.

In any one of the methods or structures disclosed herein, the drive shaft assembly may further include: inlet fluid ports; and a central aperture in fluid communication with the inlet fluid ports.

In any one of the methods or structures disclosed herein, the cutter assembly may further include: a housing including; a collar disposed therein; and a window disposed therethrough; a piston extended through the collar; a coil abutted against the piston and the collar of the housing; a pin coupled to the housing above the piston and abutted against the piston; and a blade pivotably coupled to the housing, the blade having a portion capable of being abutted against the piston.

In any one of the methods or structures disclosed herein, the cutter assembly may further include: a housing including; a collar disposed therein; and a window disposed therethrough; a coil abutted against an upper surface of the collar of the housing; and a piston disposed within the housing, the piston including; a piston head abutted against the coil; a stem extending from the piston head and extended through coil and the collar; and a pin coupled to the housing and abutted against the piston head; a blade disposed in the window, the blade including: a first portion coupled to the housing; and a cutting edge capable of being biased away from the housing.

In any one of the methods or structures disclosed herein, the first portion the blade may be pivotably coupled to the housing.

In any one of the methods or structures disclosed herein, fluid in the tubular string is capable of ingress, egress, or both, through the piston and window of the housing.

In any one of the methods or structures disclosed herein, the cutter assembly may further include an insert disposed in a piston head of the piston, wherein fluid in the tubular string is capable of ingress, egress, or both, through the insert.

In any one of the methods or structures disclosed herein, a check valve assembly may be coupled to the motor.

In any one of the methods or structures disclosed herein, the tubular cutting assembly may further include a check valve assembly coupled to the landing mandrel.

In any one of the methods or structures disclosed herein, the tubular cutting assembly may further include a check valve assembly including: a housing; and a flapper valve assembly disposed in the housing, the flapper valve assembly including: a collar; and a flapper against the collar in a closed position, wherein the flapper is capable of being biased away from the collar in an open position.

In any one of the methods or structures disclosed herein, the piston may have an aperture through which fluid is capable of ingress, egress, or both.

In any one of the methods or structures disclosed herein, the piston may be solid.

In any one of the methods or structures disclosed herein, the piston may be hollow.

Any one of the methods disclosed herein may further include passing fluid through a window disposed through a housing of the tubular cutting assembly towards the blade.

Any one of the methods disclosed herein may further include passing fluid through a relief fluid port disposed through a housing of the tubular cutting assembly towards the blade.

Any one of the methods disclosed herein may further include lifting the downhole tubular string.

Any one of the methods disclosed herein may further include stretching the downhole tubular string.

Any one of the methods disclosed herein may further include rotating the downhole tubular string.

Any one of the methods disclosed herein may further include applying torque to the downhole tubular string.

Any one of the methods disclosed herein may further include abutting a dart against a bypass sleeve disposed in a housing of a circulating valve assembly of the downhole cutting assembly; and sliding the bypass sleeve away from a bypass aperture disposed through the housing.

Any one of the methods disclosed herein may further include abutting a dart against a lock sleeve disposed in a disconnect assembly of the downhole cutting assembly; sliding the lock sleeve relative to a first housing and a second housing of the disconnect assembly, wherein the lock sleeve has a release groove disposed therein; pushing a lug out of a locking groove disposed in the second housing into the release groove; and decoupling the first housing from the second housing.

Any one of the methods disclosed herein may further include coupling a lock disposed on a landing mandrel with the landing seat.

Any one of the methods disclosed herein may further include coupling teeth of a lock disposed on landing mandrel of the tubular cutting assembly with teeth of the landing seat.

Any one of the methods disclosed herein may further include coupling teeth of a lock with teeth of the landing seat.

Any one of the methods disclosed herein may further include biasing a flapper of a check valve assembly to an open position with fluid flowed downward from above the check valve assembly.

Any one of the methods disclosed herein may further include sliding the lock sleeve away from a bypass aperture disposed in the first housing of the disconnect assembly.

Any one of the methods disclosed herein may further include inhibiting fluid below a check valve assembly from egress therethrough, wherein a flapper of the check valve assembly may be disposed in a closed position.

Any one of the methods disclosed herein may further include pumping fluid above a check valve assembly from egress therethrough, wherein the fluid causes a flapper of the check valve assembly to be biased in an open position.

Any one of the methods disclosed herein may further include inhibiting upward fluid flow below a check valve assembly from egress therethrough, wherein a flapper of the check valve assembly is disposed in a closed position.

Any one of the methods disclosed herein may further include biasing a flapper of a check valve assembly to an open position with fluid flowed downward from above the check valve assembly.

Any one of the methods disclosed herein may further include pumping cement through the disconnect assembly.

Any one of the methods disclosed herein may further include pumping cement through the circulating valve.

Any one of the methods disclosed herein may further include retracting the blade away from the downhole tubular string.

4. Specific Embodiments in the Drawings

The drawings presented herein are for illustrative purposes only and do not limit the scope of the claims. Rather, the drawings are intended to help enable one having ordinary skill in the art to make and use the claimed inventions.

Various tubular cutting assemblies and methods for cutting downhole tubular strings, have been proposed and utilized, including some of the methods and structures disclosed in some of the references appearing on the face of this application This section addresses specific versions of tubular cutting assemblies shown in the drawings, which relate to assemblies, elements and parts that can be part of a tubular cutting assembly, and methods for cutting downhole tubular strings. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability.

Although the methods, structures, elements, and parts described herein have been described in detail, it should be understood that various changes, substitutions, and alterations can be made without departing from the spirit and scope of the inventions as defined by the following claims. Those skilled in the art may be able to study the preferred embodiments and identify other ways to practice the inventions that are not exactly as described herein. It is the intent of the inventors that variations and equivalents of the inventions are within the scope of the claims, while the description, abstract and drawings are not to be used to limit the scope of the inventions. The inventions are specifically intended to be as broad as the claims below and their equivalents.

Figure 1B:
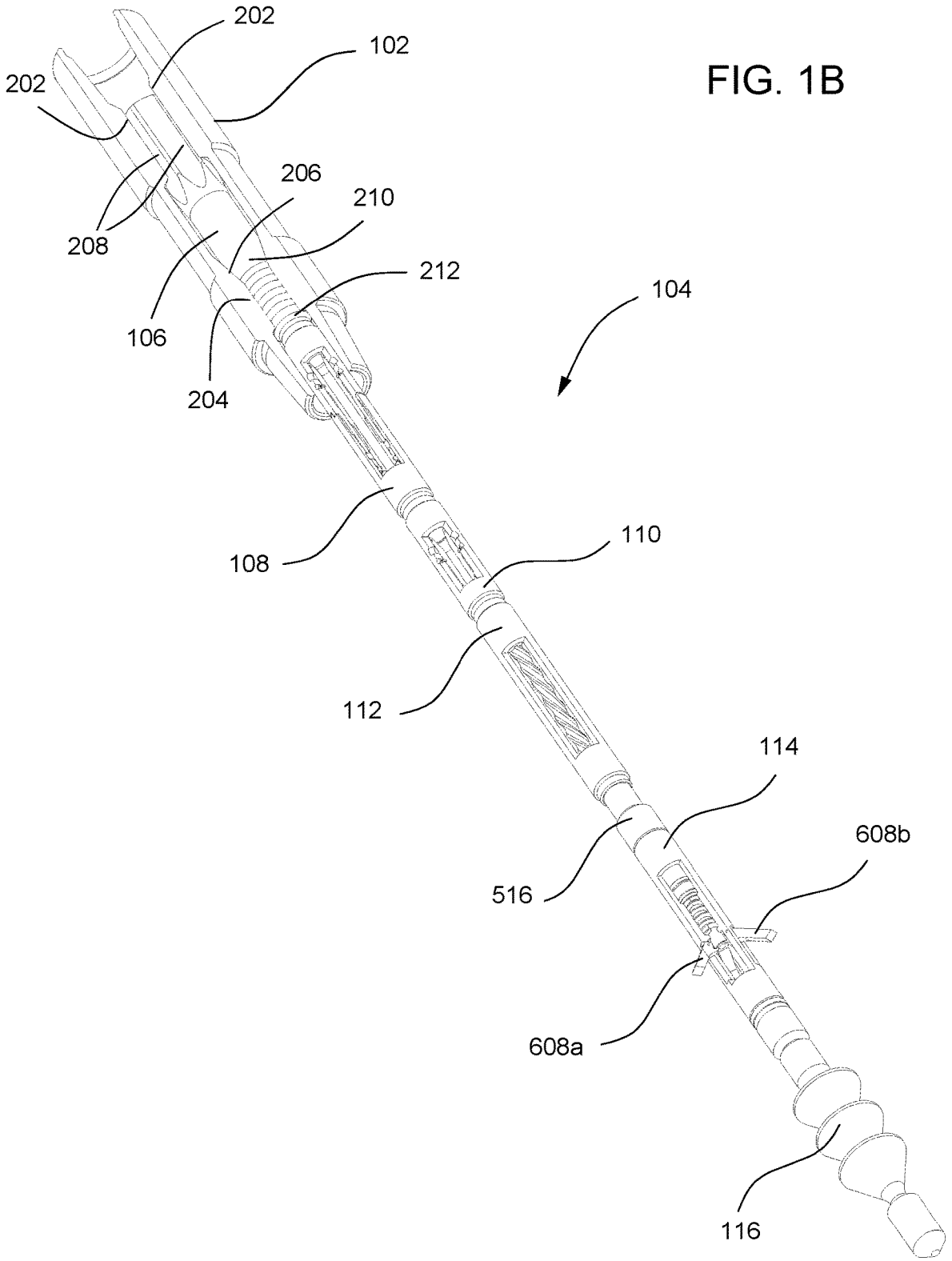
FIG. 1B illustrates a perspective view of a tubular cutting assembly including a landing seat and a tubular cutting assembly coupled to the landing seat and having blades extended.

The views of FIG. 1 illustrate perspective views of tubular cutting assemblies including seats 102 and a tubular cutting assembly 104. FIG. 1A illustrates a perspective view of a landing seat 102 anti-rotatably coupled to a tubular cutting assembly 104 having blades 608 retracted. FIG. 1B illustrates a perspective view of a landing seat 102 anti-rotatably coupled to a tubular cutting assembly 104 having blades 608 extended.

Referring to the views of FIG. 1, a tubular cutting assembly 104 may include a landing mandrel 106, a disconnect assembly 108, a circulating valve assembly 110, a check valve assembly (not shown), a motor 112, a cutter assembly 114, and a wiper plug 116. The landing mandrel 106 may be coupled to the disconnect assembly 108. The disconnect assembly 106 may be coupled to the circulating valve assembly 110. The circulating valve assembly 110 may be coupled to the motor 112. The motor 112 may be coupled to the cutter assembly 114.

In some versions, neither a disconnect assembly nor circulating valve assembly is present. The motor 112 may be coupled to the landing mandrel 106. Alternatively, a check valve assembly may be coupled to landing mandrel 106 and the motor 112.

In other versions, a circulating valve assembly may be omitted. The disconnect assembly 108 may be coupled to the landing mandrel 106. The motor 112 may be coupled to the disconnect assembly 108.

In yet other versions, a disconnect assembly may be omitted. The circulating valve assembly 110 may be coupled to the landing mandrel 106. The motor 112 may be coupled to the circulating valve assembly 110.

Figure 2A:
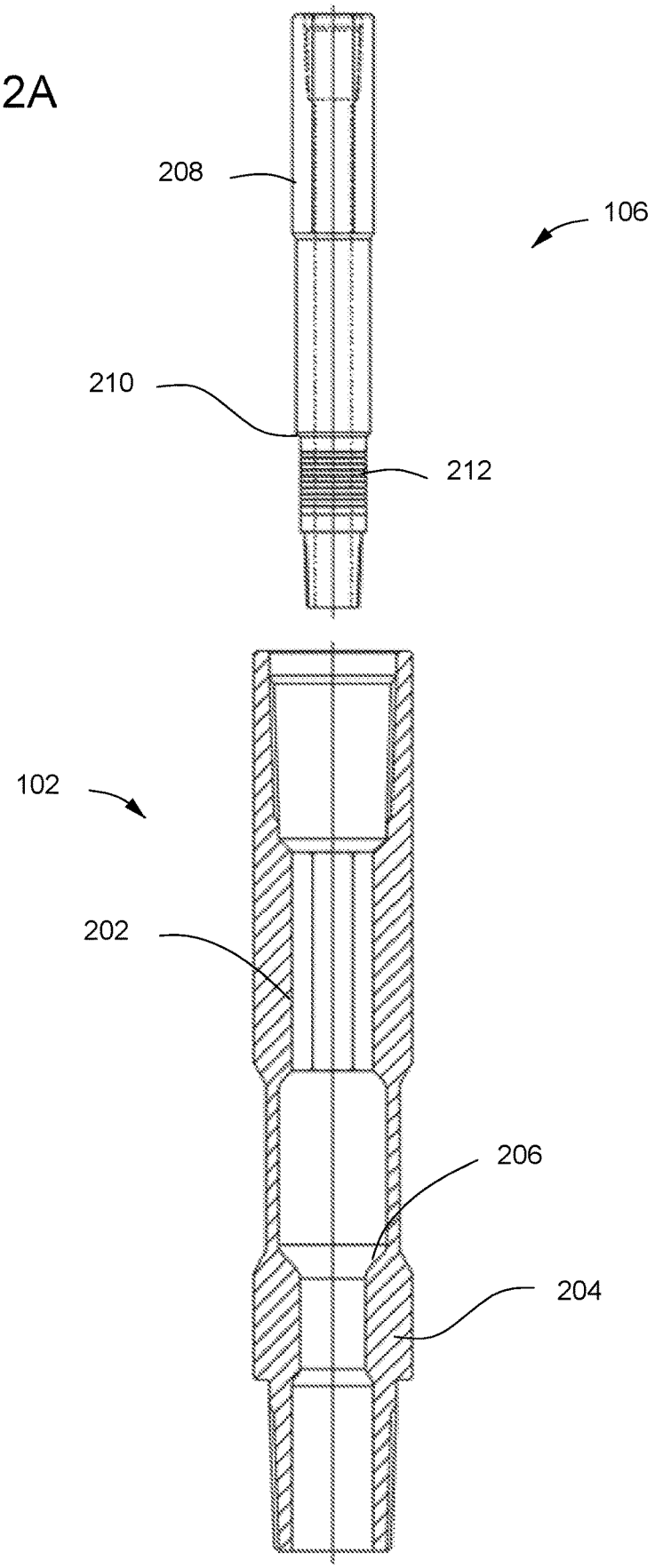
FIG. 2A illustrates a cross-sectional side view of a landing seat and a landing mandrel.
Figure 2B:
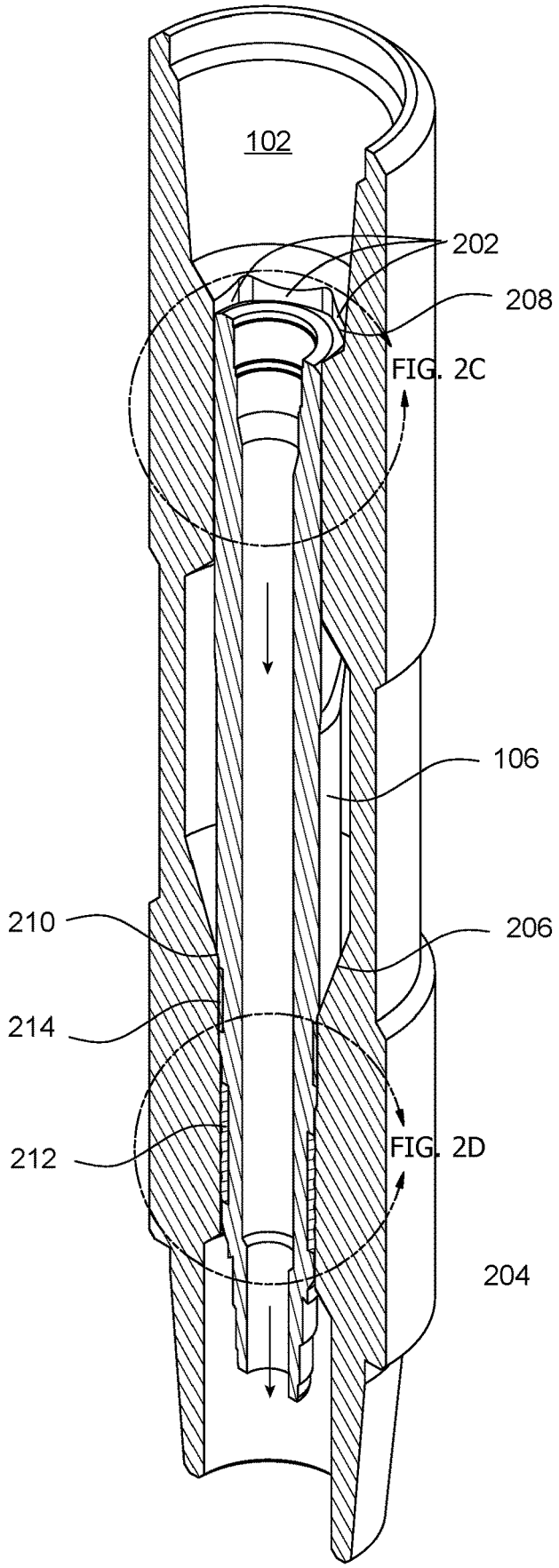
FIG. 2B illustrates a perspective cross-sectional view of a landing mandrel coupled to a landing seat.
Figure 2C:
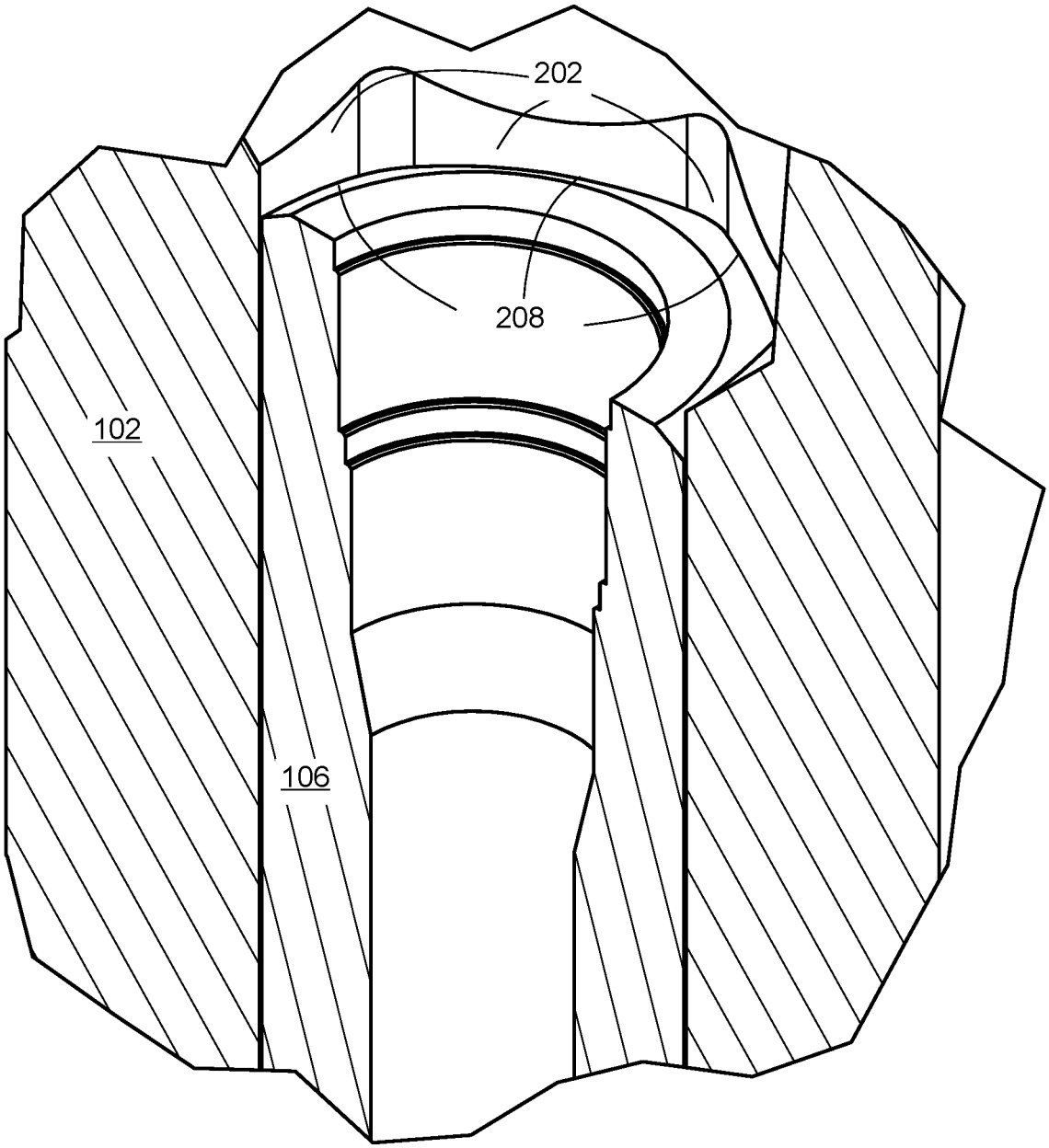
FIG. 2C illustrates a close-up perspective view of socket surfaces of the landing mandrel coupled to the landing seat in FIG. 2B.
Figure 2D:
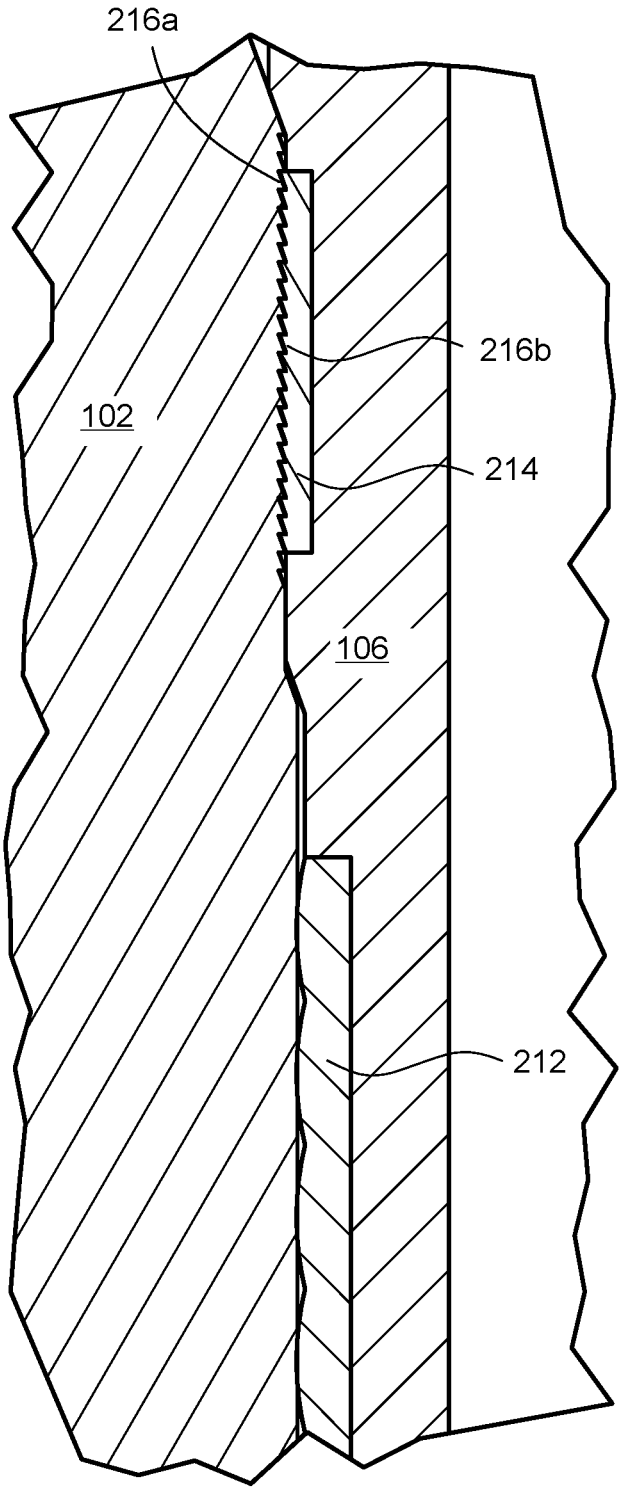
FIG. 2D illustrates a close-up perspective view of a lock coupled to the landing seat in FIG. 2B.

FIGS. 2A-B illustrate cross-sectional side views of seats 102 and landing mandrels 106. FIG. 2A illustrates a cross-sectional side view of a landing seat 102 uncoupled from a landing mandrel 106. FIG. 2B illustrates a cross-sectional side view of a landing mandrel 106 coupled to a landing seat 102. FIG. 2C illustrates a close-up view of male socket surfaces of the landing mandrel aligned with female socket surfaces of the landing seat in FIG. 2B. FIG. 2D illustrates a close-up view of a lock coupled to the landing seat in FIG. 2B.

Referring to the views of FIGS. 2A-D, a landing seat 102 may have an inner surface and an outer surface. The inner surface may define an aperture extending through the landing seat 102. An anti-rotation portion of the inner surface of the landing seat 102 may have one or more socket surfaces 202. The socket surfaces 202 may be disposed at an upper end of the landing seat 102. A landing collar 204 may extend inwardly from the inner surface towards the central axis line of the landing seat 102. The landing collar 204 may have an inner tapered surface 206. The inner tapered surface 206 may have a beveled, conical, and/or frustoconical shape.

A landing mandrel 106 may have an inner surface and an outer surface. A landing portion of the outer surface of the landing mandrel 106 may have an outer tapered surface 210 having a tapered profile. The outer tapered surface 210 may have a beveled, conical, and/or frustoconical shape. The outer tapered surface 210 of the landing mandrel 106 may be abutted against the inner tapered surface 206 of the landing collar 204.

An anti-rotation portion of the outer surface may have one or more male socket surfaces 208 (FIG. 2C). Each male socket surface 208 may be aligned with a female socket surface 202 of the landing seat 102. Portions of the male socket surfaces 208 may be abutted against portions of the socket surfaces 202 of the landing seat. Accordingly, when portions of the socket surfaces 202, 208 are abutted against each other, they would inhibit rotation of the landing mandrel 106 relative to the landing seat 102. Therefore, the landing mandrel 106 may be anti-rotatably coupled to the landing seat 102.

A seal portion of the outer surface of the landing mandrel 106 may have seals 212 disposed thereon. The seals 212 may be sealably abutted against the collar 206. Each seal 212 may be made from elastomeric material, e.g., silicone, fluorocarbon rubber (FKM), nitrile rubber (NBR), hydrogenated nitrile (HNBR), or acrylonitrile butadiene rubber. Each seal 212 may be made from plastic material, e.g., PEEK, PTFE, or PE-UHMW. Each seal 212 may be made from metallic material.

A lock 214 may be disposed circumferentially on the outer surface of the landing mandrel 106. A spring (not shown) be disposed between the lock and the outer surface of the landing mandrel 106. The spring may bias the lock 214 away from the outer surface of the landing mandrel 106. Thus, a portion of the lock 214 may protrude from the mandrel 106. In addition, the lock 214 may have teeth 216*a* (FIG. 2D). The teeth 216*a* may be coupled to teeth 216*b* disposed in the inner surface of the landing seat 102. Once the teeth 216*a*, 216*b* are coupled, the landing mandrel 106, in some cases, is inhibited from being uncoupled from the landing seat 102. Therefore, the landing mandrel 106 may further be fixedly coupled to the landing seat 102.

In addition, pin threads may be disposed at a lower end of the landing mandrel 106. The pin threads may be coupled to box threads (not shown) of a disconnect assembly 108 (FIGS. 1A-B).

Figure 3A:
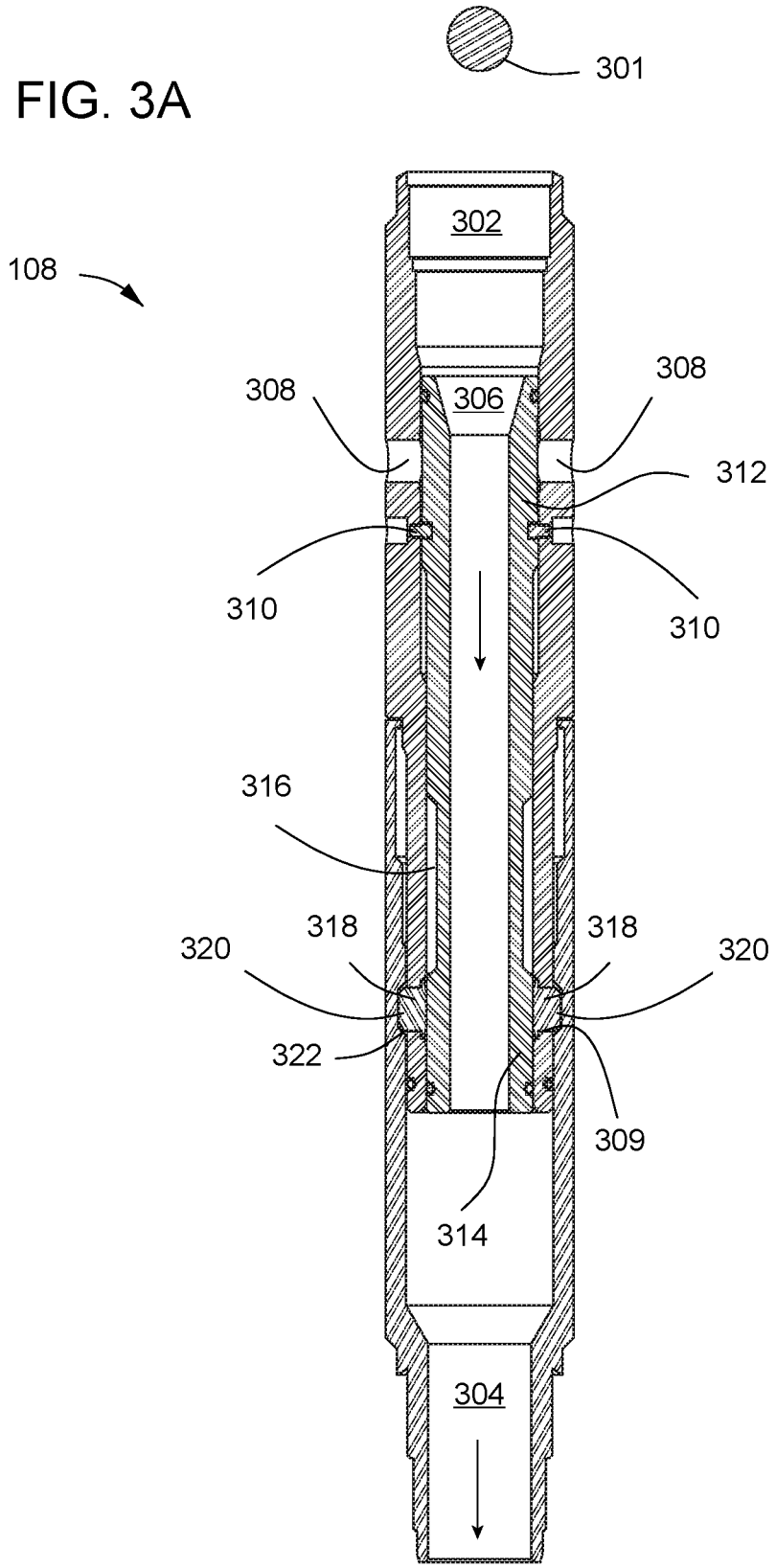
FIG. 3A illustrates a cross-sectional side view of a disconnect assembly and a dart.

FIG. 3A illustrates a cross-sectional side view of a disconnect assembly 108 including an upper housing 302, a lower housing 304, and a lock sleeve 306 coupled together in a locked position. A dart 301 may be pumped from the surface and landed on the lock sleeve 306. The upper housing 302 may have an inner surface and an outer surface. The outer surface may have box threads disposed at an upper end of the upper housing 302. The box threads may be coupled to pin threads of the landing mandrel (not shown). Bypass fluid ports 308 may be disposed through the upper housing 302. One or more retaining apertures 309 may be disposed through the upper housing 302. Furthermore, a lower portion of the upper housing 302 may be disposed within the lower housing 304.

The lower housing 304 may have an inner surface and an outer surface. The inner surface may define an aperture extending through ends of the lower housing 304.

The lock sleeve 306 may have an upper portion disposed concentrically in the upper housing 302 and a lower portion disposed concentrically in the lower housing 304. The lock sleeve 306 may be shearably coupled to the upper housing 302 via shear pins 310. The lock sleeve 306 may have an inner surface and an outer surface. The inner surface of the lock sleeve 306 may define an aperture extending through ends of the lock sleeve 306.

The lock sleeve 306 may have a bypass obstruction portion 312. The bypass obstruction portion 312 may have an outer surface capable of obstructing the bypass fluid ports 308 disposed through the upper housing 302. Accordingly, the bypass obstruction portion 312 may inhibit fluid egress from within the disconnect assembly 108 through the bypass fluid port 308.

In addition, the lock sleeve 306 may have a locking portion 314 and a release groove 316. The release groove 316 may be disposed in the outer surface of the lock sleeve 306. The release groove 316 may be disposed above the locking portion 314.

Also, the lock sleeve 306 may be shearably coupled to the upper housing 302 via pins 310.

The upper housing 302 and the lower housing 304 may be removably coupled. The lower housing 304 may have a locking groove 322 disposed in its inner surface. Lugs 318 may be extended through each retaining aperture 309. Each lug 318 may have a tapered end 320 disposed in a locking groove 322. The lugs 318 may be "free floating" in the retainer aperture 309 and locking groove 322. However, an outer surface of the locking portion 314 of the lock sleeve 306 may be abutted against each lug 318. Accordingly, the locking portion 314 may inhibit each lug 318 from egress from the locking groove 322. Thus, the upper housing 302 and the lower housing 304 may remain coupled via lugs 318.

In various versions, other types of lock may be used instead of lugs. For instance, in some versions, steel balls may be used. In other versions, a lug 318 may be coupled to collet fingers of an upper housing 302. The collet fingers may extend from an end of the upper housing 302. The collect fingers are capable of being biased inward toward a central axis of the upper housing 302.

Figure 3B:
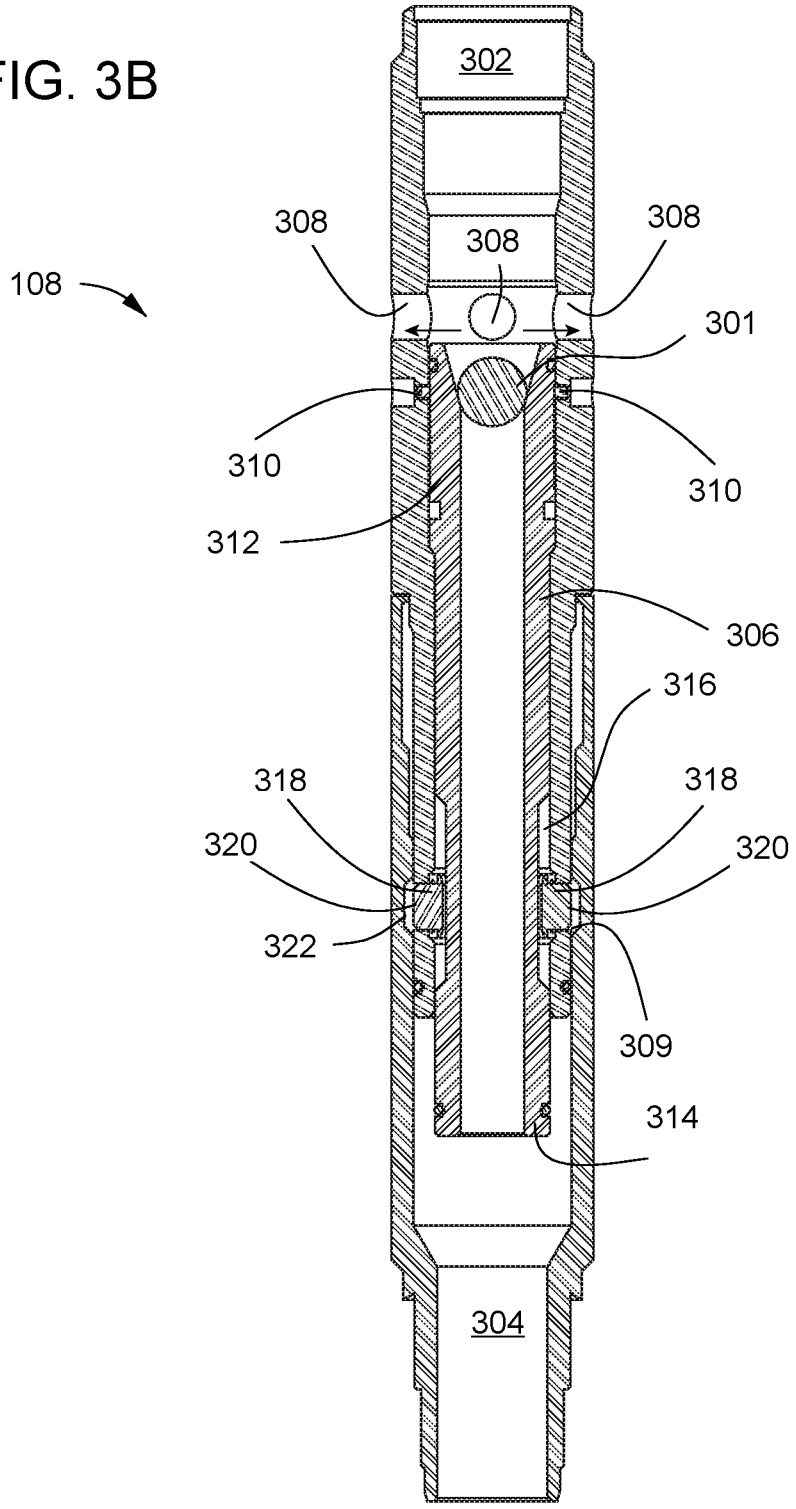
FIG. 3B illustrates a cross-sectional side view of a disconnect assembly having received a dart.

FIG. 3B illustrates a cross-sectional side view of a disconnect assembly 108 including an upper housing 302 and a lower housing 304, and a lock sleeve 306 in an unlocked position, and a dart 301 seated on the lock sleeve 306. The lock sleeve 306 may have an inner surface having a release groove 316 disposed circumferentially therein. The release groove 316 may be aligned with lugs 318. Additionally, the lock sleeve 306 may be slid below the bypass fluid port 308. In some cases, a bypass obstruction portion 312 of the lock sleeve 306, may not obstruct the bypass fluid ports 308 in the upper housing 302.

Figure 3C:
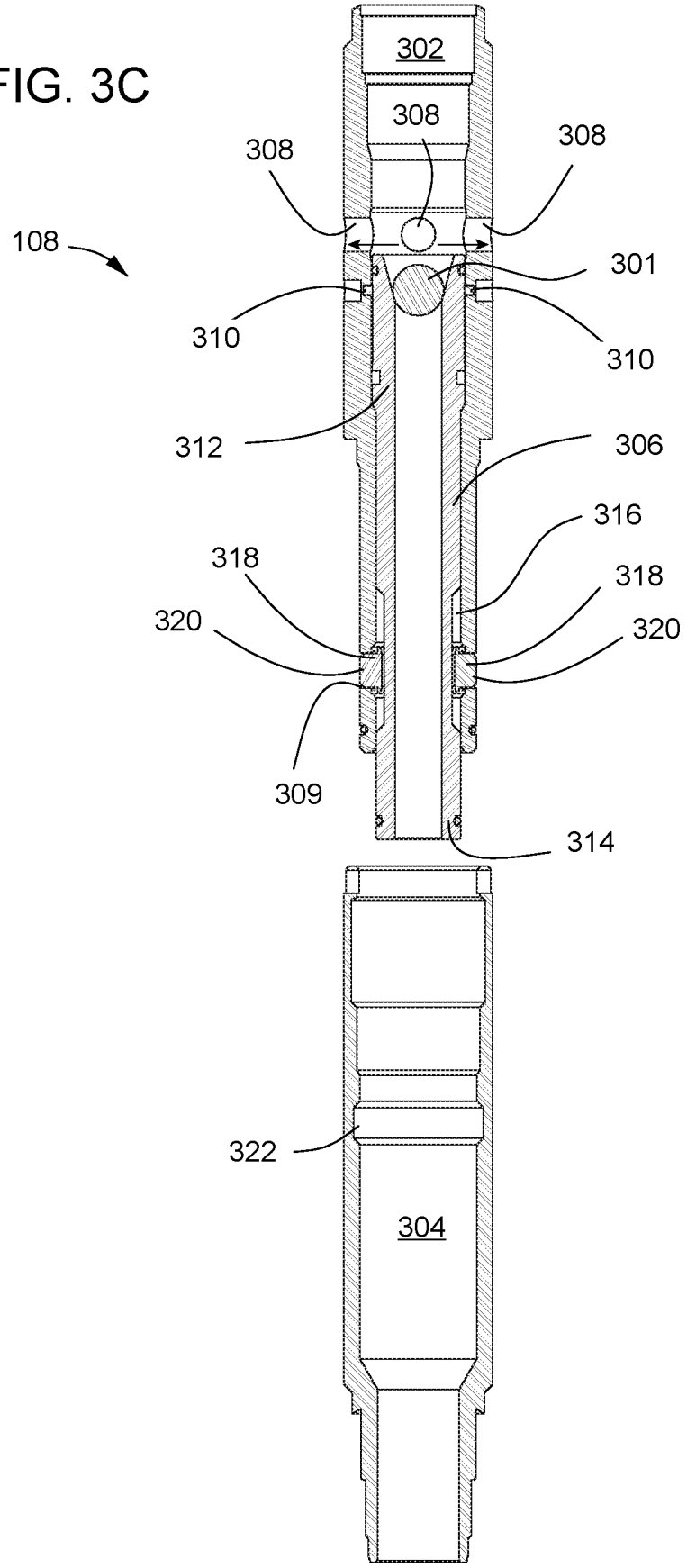
FIG. 3C illustrates a cross-sectional side view of a disconnect assembly having an upper housing uncoupled from a lower housing.

FIG. 3C illustrates a cross-sectional side view of a disconnect assembly 108 having an upper housing 302 and a lower housing 304 uncoupled. Lugs 318 may be slid through the upper housing towards the central axis of the disconnect assembly 108. The lugs 318, in some cases, may each have a tapered end 320 that are not disposed in a locking groove 322. In the unlocked position, the lugs 318 may each have a portion disposed in the release groove 316 and a tapered end 320 dispose away from the locking grooves 322. Thus, the upper housing 302 may be slid away from the lower housing 304 unobstructed.

Figure 3D:
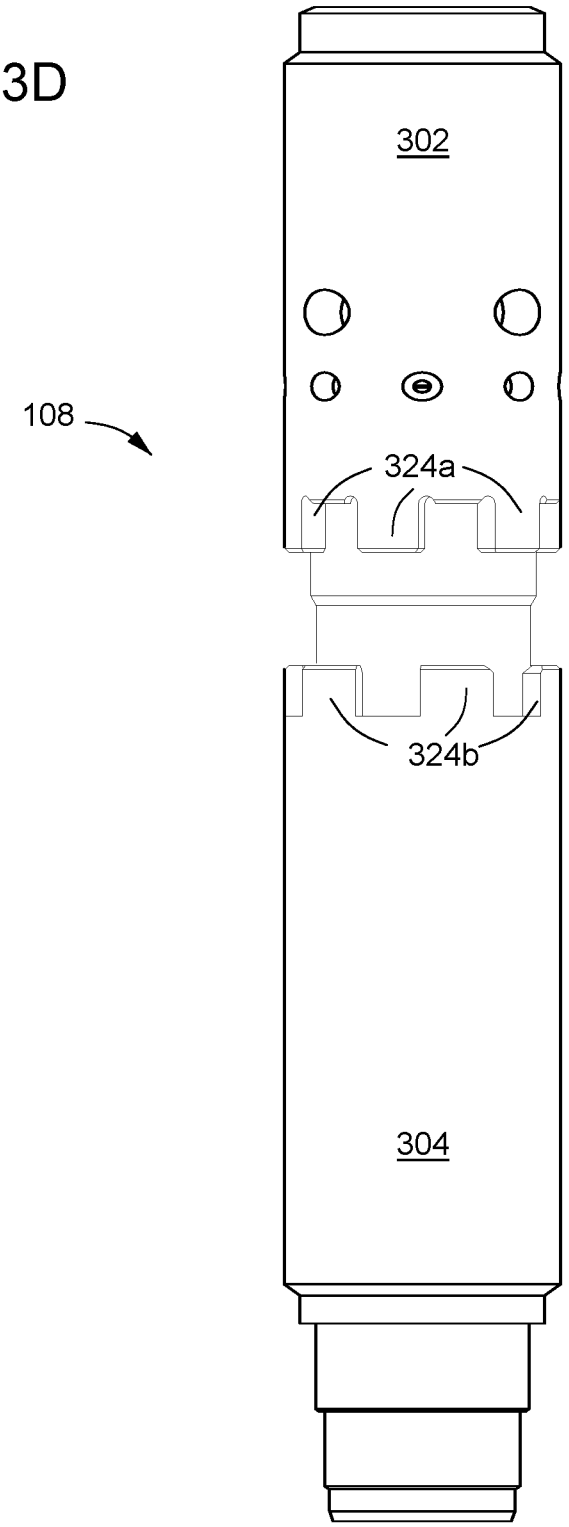
FIG. 3D illustrates a profile view of a disconnect assembly having an upper housing and a lower housing uncoupled.

FIG. 3D illustrates a profile view of the disconnect assembly 108 having an upper housing 302 and a lower housing 304 uncoupled. The upper housing 302 may include a first castellation face 324*a*. The lower housing 304 may include a second castellation face 324*b*. The first castellation face 324*a* of the upper housing may be capable of meshing with the second castellation face 324*b* of the lower housing of the disconnect assembly. Thus, when the first castellation face 324*a* is meshed with the second castellation face 324*b*, the upper housing 302 and the lower housing 304, in some cases, would be inhibited from being rotated relative to each other.

Figure 4A:
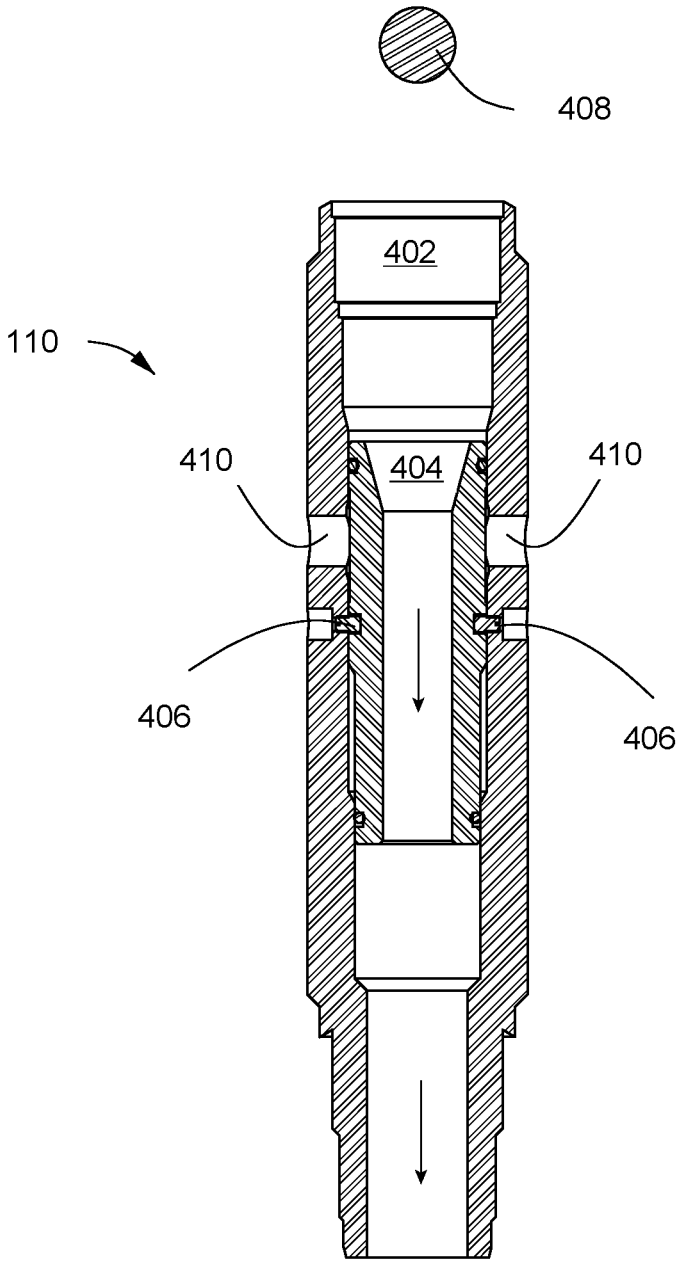
FIG. 4A illustrates a cross-sectional side view of a circulating valve assembly including a housing and a bypass sleeve disposed in a closed position in the housing.

FIG. 4A illustrates a cross-sectional side view of a circulating valve assembly 110 including a housing 402 and a bypass sleeve 404 disposed in the housing 402 in a closed position. A dart 408 may be pumped from the surface and landed on the bypass sleeve 404. The housing 402 may have an inner surface and an outer surface. The outer surface may have box threads disposed at an upper end of the housing 402. The box threads may be coupled to pin threads of a lower housing 304 of a disconnect assembly (not shown). Additionally, pin threads may be disposed on the outer surface at a lower end of the housing 402.

The bypass sleeve 404 may have an inner surface and an outer surface. The bypass sleeve 404 may be disposed concentrically in the housing 402. Also, the bypass sleeve 404 may be shearably coupled to the housing 402 via pins 406. Additionally, a portion of the outer surface of the bypass sleeve 404 may obstruct bypass fluid ports 410 disposed through the housing 402. A seal (not shown) may be disposed on the bypass sleeve 404 below the bypass fluid ports 410. Accordingly, the bypass obstruction portion 412 may inhibit fluid egress from within the bypass valve 110 through the bypass fluid port 410.

Figure 4B:
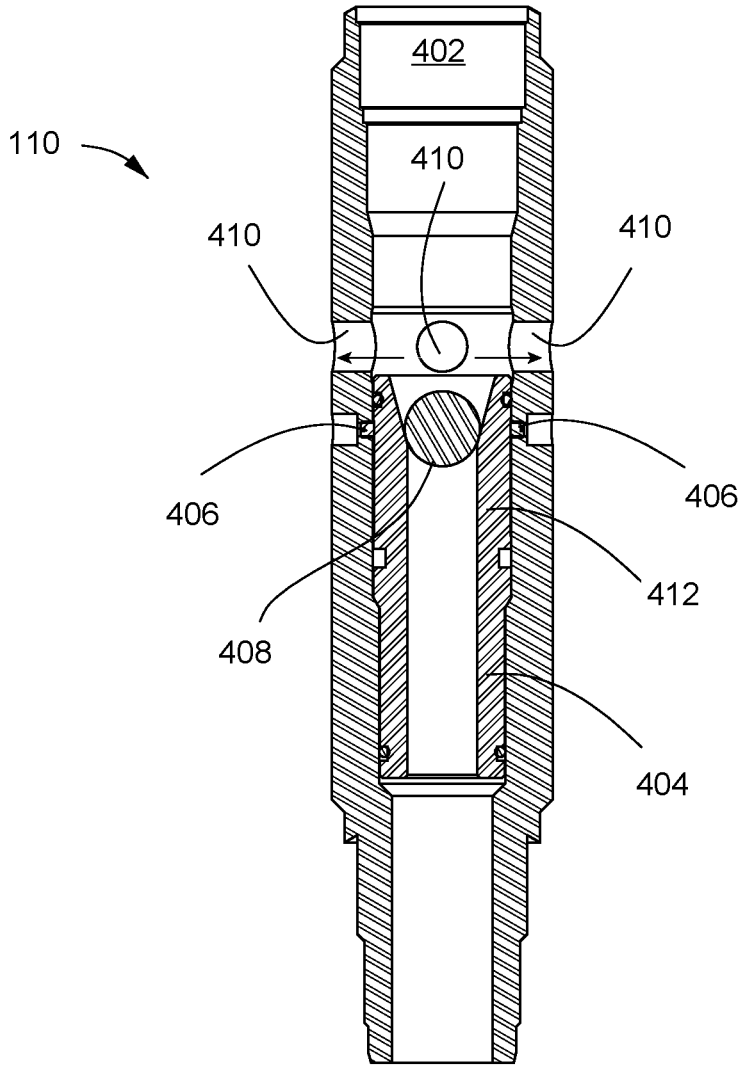
FIG. 4B illustrates a cross-sectional side view of a circulating valve assembly including a housing and a bypass sleeve disposed in an open position in the housing.

FIG. 4B illustrates a cross-sectional side view of a circulating valve assembly 110 including a housing 402 and a bypass sleeve 404 disposed in an open position in the housing 402. A dart 408 may be landed on the bypass sleeve 404.

In the open position, the bypass sleeve 404 may be disposed below bypass fluid ports 410 disposed through the housing 402. Thus, in some cases, the bypass sleeve 404 may not obstruct the bypass fluid ports 410. Accordingly, fluid within the bypass valve 404 may be flowed through the bypass fluid ports 410.

Figure 5:
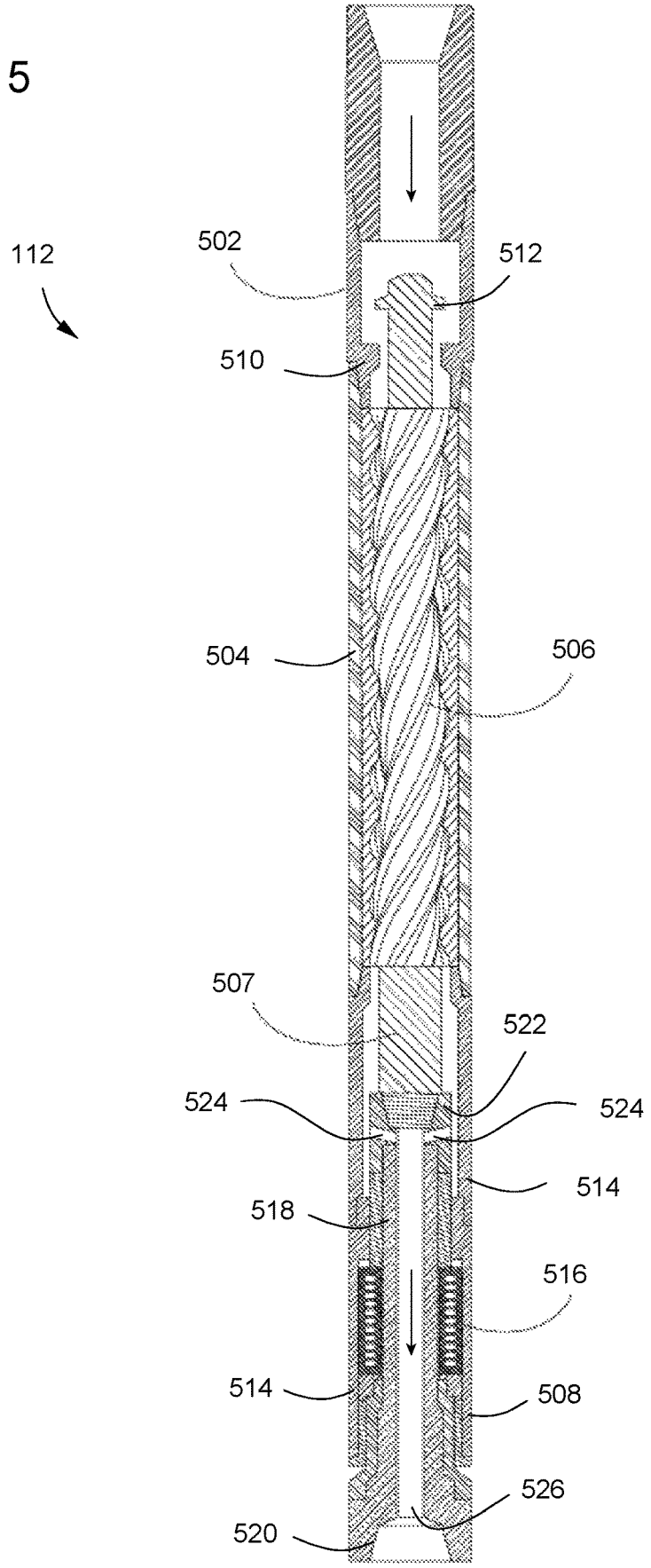
FIG. 5 illustrates a cross-sectional side view of a motor.

FIG. 5 illustrates a cross-sectional side view of a motor 112. The motor 112 may include an anti-drop adapter 502, a stator 504, a rotor 506, and a drive shaft assembly 508. The anti-drop adapter 506 may be threadably coupled to an upper end of the stator 504. The anti-drop adapter 502 may have an inner surface having an inner collar 510 extending therefrom. A portion of the rotor 506 may be extended through the inner collar 510 into the stator 504. Additionally, the rotor 506 may have an upper end having a rotor catch 512 extending outwardly therefrom. The rotor catch 512 of the rotor 506 is capable of being abutted against the inner collar 510 of the anti-drop adapter 502. Therefore, in some cases, the anti-drop adapter 502 may inhibit the rotor 506 from falling through the anti-drop adapter 502.

Additionally, the lower end of the rotor 506 may include a universal coupling adaptor 507. The universal coupling adaptor 507 may be a flexible shaft. Moreover, the universal coupling adaptor 507 may be threadably coupled to an upper end of the drive shaft assembly 508.

In some versions, the universal coupling adaptor 507 of the rotor 506 may be a U-joint (not shown) pivotably coupled to an upper end of the drive shaft assembly 508.

Returning to FIG. 5, the drive shaft assembly 508 may include a housing 514, bearing assemblies 516, and a drive shaft 518. The housing 514 may be coupled (e.g., via threads) to a lower end of the stator 504. The bearing assembly 516 may be rotatably coupled to the housing 514. The drive shaft 518 may be rotatably coupled to the bearing assemblies 516. The bearing assembly 516 may be rotatably coupled to the drive shaft 518. Further, the bearing assembly 516 may be coupled to the housing 514. The drive shaft 518 may have a lower end having box threads 520 that are capable of being coupled to pin threads of a cutter assembly (not shown).

Additionally, the drive shaft 518 may include a coupler 522. The coupler 522 may be coupled to the universal coupling adaptor 507 of the rotor 506. Inlet fluid ports 524 may be disposed through the coupler 522. Fluid in the motor 110 may be flowed through the inlet fluid ports 524. Furthermore, a central aperture 526 may be disposed through the ends of drive shaft 518 (including the coupler 522). The central aperture 526 may be in fluid communication with the inlet fluid ports 524.

Figure 6A:
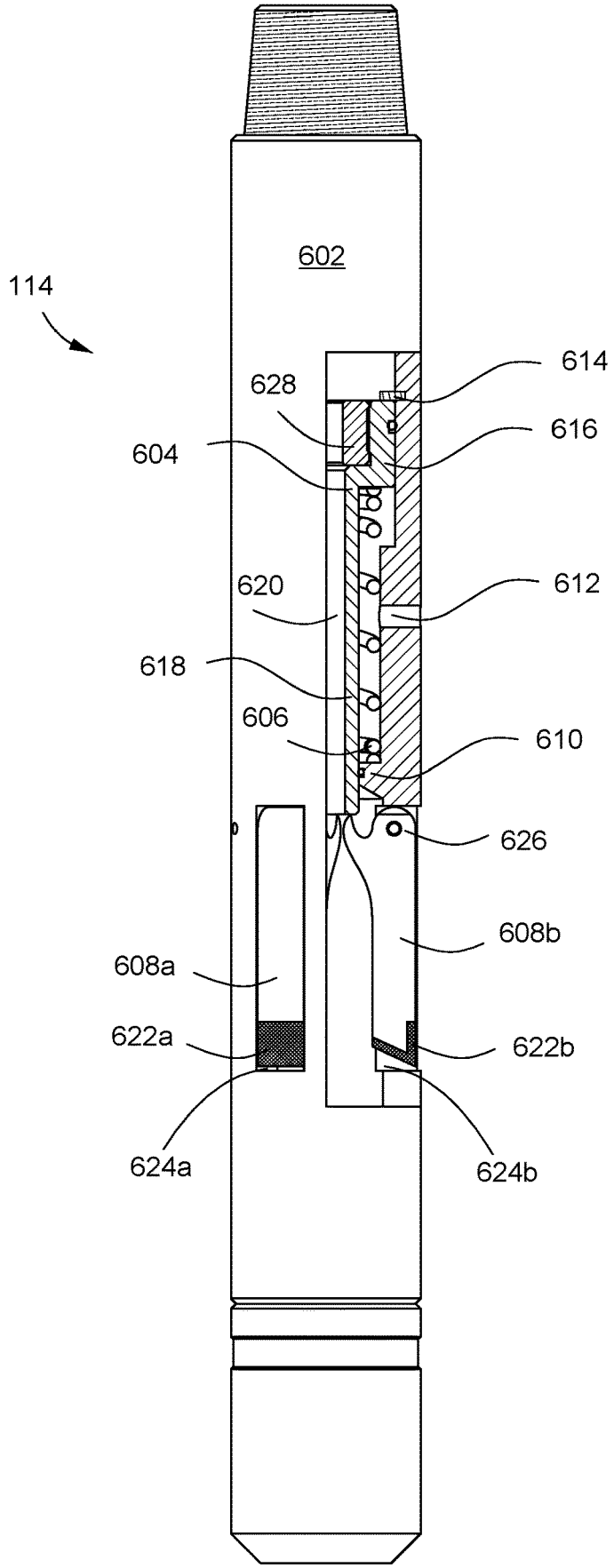
FIG. 6A illustrates a cross-sectional side view of a cutter assembly having blades in a retracted position.

FIG. 6A illustrates a cross-sectional side view of a cutter assembly 114 including blades 608*a*, 608*b* disposed in a retracted position. The cutter assembly 114 may include a housing 602, a piston 604, a coil 606, and the blades 608*a*, 608*b*. The housing 602 may have an inner surface and an outer surface. Pin threads may be disposed on the outer surface at an upper end of the housing 602. The pin threads may be coupled to box threads 520 of a drive shaft assembly 518 of a motor (not shown). A first portion of the inner surface may have a collar 610 extended therefrom towards the central axis line of the cutter assembly 114. The coil 606 may be disposed on an upper surface of the collar 610. Additionally, fluid ports 612 may be disposed through the housing 602 adjacent to the coil 606. Furthermore, pins 614 may be disposed in the inner surface of the housing 602. The pins 614 may be disposed above the piston 604.

The piston 604 may have a piston head 616 and a stem 618. The piston head 616 and the stem 618 may be unitary. The stem 618 may be extended through the coil 606 and the collar 610 of the housing 602. The piston head 616 may be disposed above the coil 606. Therefore, the coil 606 may be disposed between the collar 610 and the piston head 616. Furthermore, the coil 606 may be abutted against the collar 610 and the piston head 616. Thus, the coil 606 may cause the piston head 616 of the piston 604 to be biased away from the collar 610. However, an upper surface of the piston head 616 may be abutted against the pins 614. Thus, the pins 614 may inhibit movement of the piston 604 away from the collar 610.

Additionally, an inner surface of the piston 604 may define a central aperture 620 extending through the piston head 616 and the stem 618. A first portion of the inner surface of piston 604 in the piston head 616 may define a first diameter. A second portion of the inner surface of the piston 604 in the stem 618 may define a second diameter. The second diameter may be smaller than the first diameter.

Fluid may be flowed through the central aperture 620. An insert 628 may be disposed in the central aperture 620 concentric with the piston head 616. The insert 628 may have an inner surface that defines an aperture therethrough. Also, the inner surface of the insert 628 may define a third diameter. The third diameter of the insert 628 may range from 3/16 inch to 7/8 inch. The third diameter of the inner surface of the insert 628 may be smaller than or equal to the second diameter defined by the second portion of the surface of the piston 604 in the stem 618. The insert 628 may inhibit fluid flow through the piston 604.

Figure 6B:
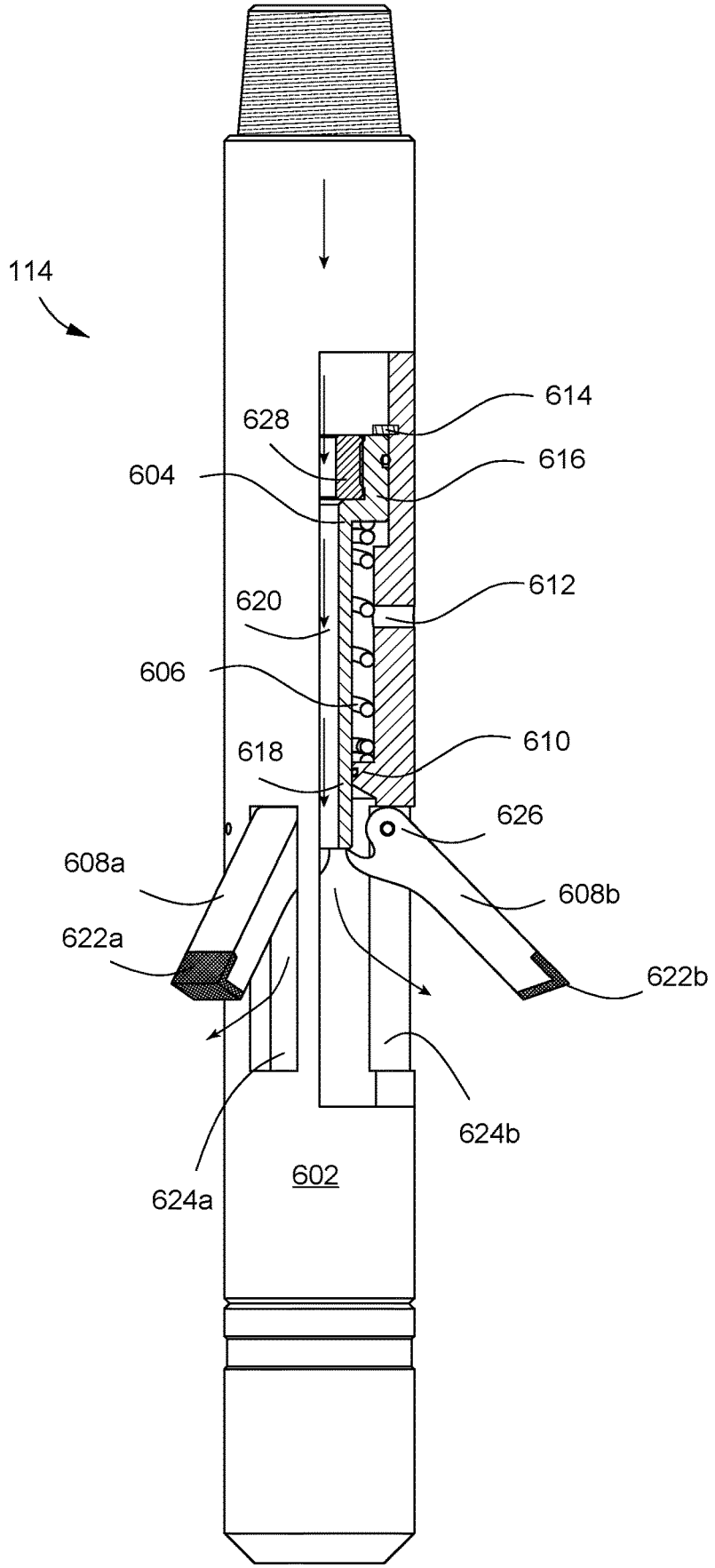
FIG. 6B illustrates a cross-sectional side view of a cutter assembly having blades in an extended position.

FIG. 6B illustrates a cross-sectional side view of a cutter assembly having blades in a cutting position. When the blades 608 are in a cutting position, the stem 618 may be abutted against a first portion of each blade 608. Each blade 608 may have pivot portion 626 pivotably coupled to the housing 602. Also, each blade 608*a*, 608*b* may be disposed in a window 624 extending through the housing 602. When the first portion of each blade 608 is pushed, each blade 608 would have a cutting end pivoted outwardly from the window 624 away from the housing 602. Each blade 608 may have a cutting end 622. The cutting end 622 be composed of material such as tungsten carbide.

Figure 6C:
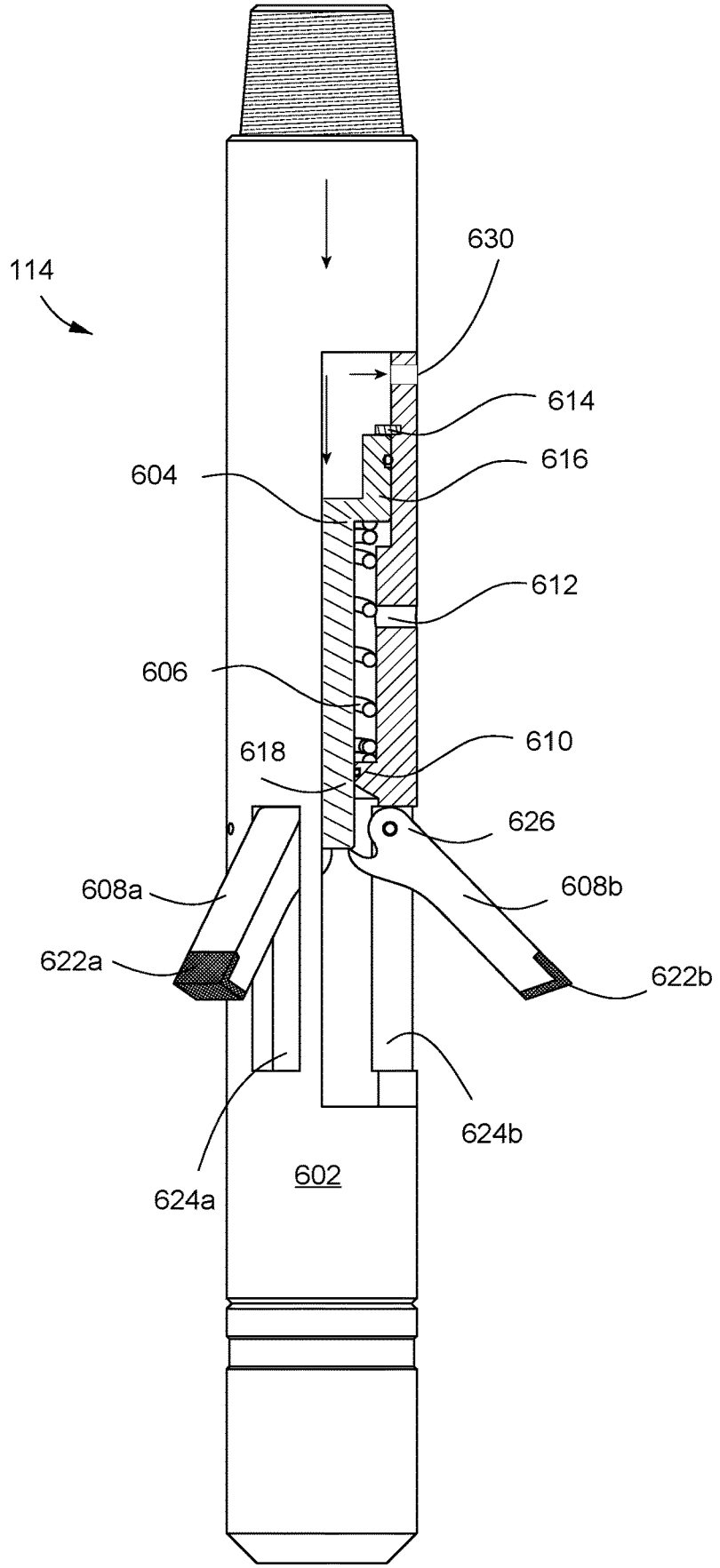
FIG. 6C illustrates a cross-sectional side view of another cutter assembly having a piston that is solid.

FIG. 6C illustrates a cross-sectional side view of another exemplary cutter assembly 114 having blades 608*a*, 608*b* in a cutting position. The cutter assembly 114 may include a housing 602, a piston 604, a coil 606, and the blades 608*a*, 608*b*. The housing 602 may have an inner surface and an outer surface. Pin threads may be disposed on the outer surface at an upper end of the housing 602. The pin threads are capable of being coupled to box threads 520 of a drive shaft assembly 518 of a motor (not shown).

A first portion of the inner surface may have a collar 610 extended therefrom towards the central axis line of the cutter assembly 114. The coil 606 may be disposed on an upper surface of the collar 610. Also, fluid ports 612 may be disposed through the housing 602 adjacent to the coil 606. Furthermore, pins 614 may be disposed in the inner surface of the housing 602. The pins 614 may be disposed above the piston 604.

One or more relief fluid ports 630 may be disposed through the housing 602. The one or more relief fluid ports 630 may be disposed above the piston 604. Fluid, e.g., mud, may be passed from the relief fluid ports 630. The one or more relief fluid ports 630 may be disposed at an angle relative to the central axis of the housing 602. The angle of the one or more relief fluid port 626 may range from 10, 20, 30, or 45 to 50, 60, 70, 80, or 90 degrees, or greater.

The housing 602 of the cutter assembly 114 may have one or more fluid ports 612 disposed therethrough. The fluid ports 612 may be adjacent to the piston 604 and the coil 606. Fluid in the cutter assembly 114 may be flowed through the one or more fluid ports 612. Conversely, fluid outside of the cutter assembly 114 may be flow through the one or more fluid ports 612.

The piston 604 may be solid. In addition, the piston 604 may be disposed below the pins 614. Also, the piston 604 may have a piston head 616 and a stem 618. Additionally, the piston head 616 and the stem 618 may be unitary. Moreover, the stem 618 of the piston 604 may be extended through the coil 606 and the collar 610. The piston head 616 may be disposed above the coil 606. Accordingly, the coil 606 may be disposed between the collar 610 and the piston head 616. Furthermore, the coil 606 may be abutted against the collar 610 and the piston head 616. Thus, the coil 606 may cause the piston head 616 of the piston 604 to be biased away from the collar 610. However, an upper surface of the piston head 616 may be abutted against the pins 614. Thus, the pins 614 may inhibit movement of the piston 604 away from the collar 610.

In a cutting position, the stem 618 may be abutted against a first portion of each blade 608. Each blade 608 may have an end pivotably coupled to the housing 602. Also, each blade 608 may be disposed in a window 624 disposed through the housing 602. When the first portion of each blade 608 is pushed, each blade 608 would have a cutting end pivoted outwardly from the window 624 away from the housing 602. Each blade may have a cutting end 622. The cutting end 622 be composed of material such as tungsten carbide. The cutting end 622 may also have material that include tungsten, molybdenum, chromium, vanadium, cobalt, and/or carbon.

Figure 7A:
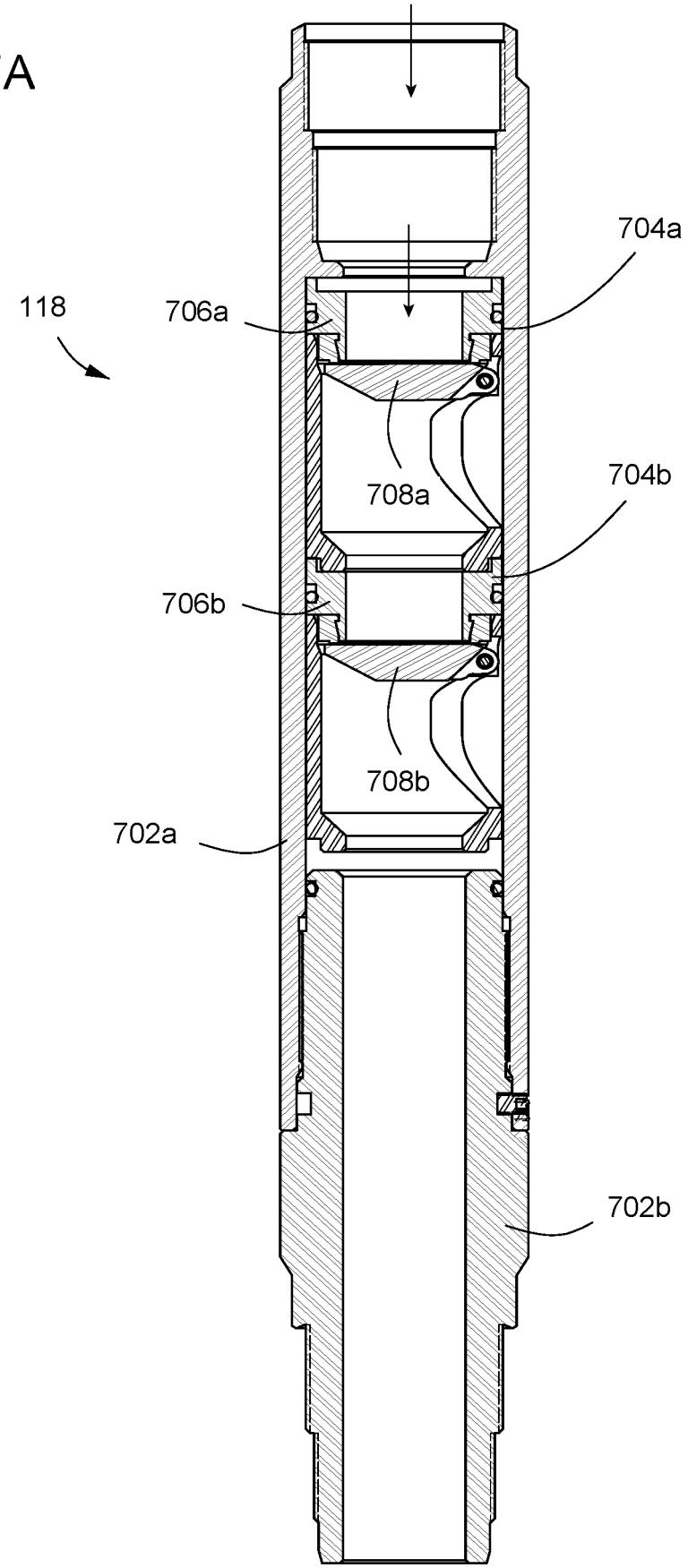
FIG. 7A illustrates a cross-sectional side view of a check valve assembly having flapper assemblies in a closed position.

FIG. 7A illustrates a cross-sectional side view of a check valve assembly 118 having flapper assemblies 704*a*, 704*b* in a closed position. The check valve assembly 118 may include a first housing 702*a*, a second housing 702*b*, and the one or more flapper assemblies 704*a*, 704*b*. The first housing 702*a* and the second housing 702*b* may be coupled to form a longer housing. The first housing 702*a* may have an inner surface and an outer surface. Box threads may be disposed on the inner surface at an upper end of the first housing 702*a*. The box threads may be coupled to pin threads of a landing mandrel (not shown).

The second housing 702*b* may also have an inner surface and an outer surface. Pin threads may be disposed on the outer surface at an upper end of the second housing 702*b*. The pin threads may be coupled to box threads at a lower end of the first housing 702*a*. Pin threads may also be disposed on the outer surface at a lower end of the second housing 702*b*. The pin threads are capable of being coupled to box threads of a motor (not shown).

The flapper assemblies 704*a*, 704*b* may be disposed as a stack within the first housing 702*a*. The first flapper assembly 704*a* be abutted against a collar within the first housing 702*a*. The second flapper 704*b* may be abutted against the first flapper 704*a*. An upper face of the second housing 702*b* may be abutted the second flapper assembly 704*b*. Thus, the flapper assemblies 704*a*, 704*b* may be retained in the housing 702*a*.

Each flapper assembly 704 may include a housing 706, a flapper 708, and a spring (not shown). The flapper 708 may be pivotably coupled to the housing 706. The spring may be coupled to the flapper 708 of each lapper assembly 704. The spring may cause the flapper 708 to be biased against the housing 706 in closed position. Thus, in the closed position, fluid below each flapper assembly 704 may not be flowed upwards therethrough.

Figure 7B:
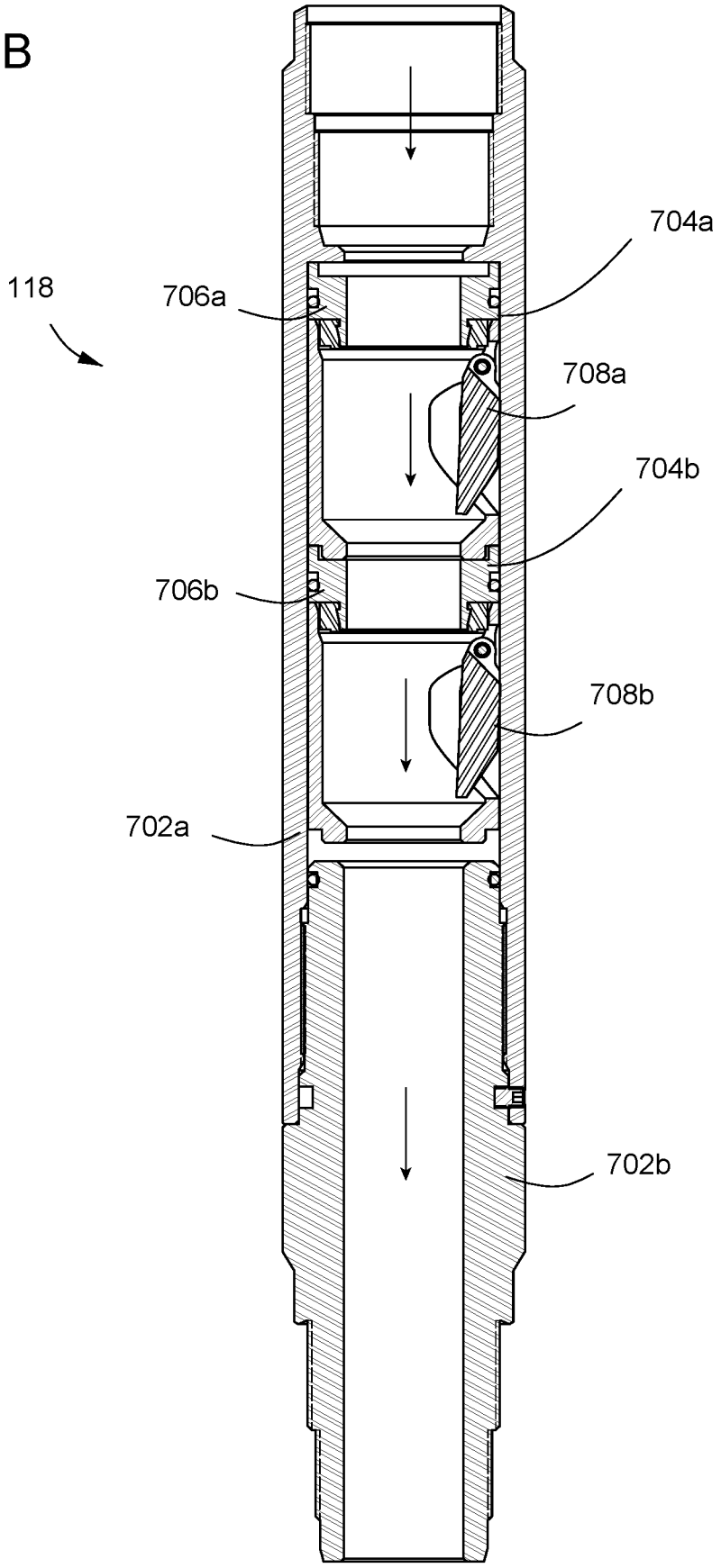
FIG. 7B illustrates a cross-sectional side view of a check valve assembly having flapper assemblies in an open position.

FIG. 7B illustrates a cross-sectional side view of a check valve assembly 118 having one or more flapper assemblies 704*a*, 704*b* in an open position. Fluid may be flowed into each check valve assembly 118 from above. At each check valve assembly 118, the fluid may cause a flapper 708 in each flapper assembly 704 to be bias downward into an open position. The fluid may then continue to be flowed down through the check valve assembly 118. Additionally, darts (not shown) may be carried in the fluid through the check valve assembly 118.

In alternate versions, a check valve assembly 118 may be coupled between a disconnect assembly 108 and a motor (not shown). In some versions, a check valve assembly 118 may be coupled between a circulating valve assembly (not shown) and a motor (not shown). In other versions, a check valve assembly 118 may be coupled to an upper end of a disconnect assembly 108 or a bypass valve 110.

Referring to the views of FIGS. 1-6, an operator may perform the following steps to cut a downhole tubular string, e.g., casing, drill pipe, or liner hanger, that may include a landing seat 102 coupled thereto. The landing seat 102 may be coupled to a portion of the downhole tubular string at the surface and "tripped" downhole prior to drilling. First, the operator may deploy a tubular cutting assembly 104 down the downhole tubular string. The operator may place the tubular cutting assembly 104 into an opening of the downhole tubular string at the surface. The operator may release the tubular cutting assembly 104 without pumping any fluid. Gravity may cause the tubular cutting assembly 104 to fall down the downhole tubular string. Preferably, the operator may pump the tubular cutting assembly 104 along with fluid down the downhole tubular string at a pump down fluid flow rate. The pump down fluid flow rate may range from as low as 5, 10, 20, 30, 40 gallons per minute to as high as 45, 50, 55 gallons per minute or higher. The tubular cutting assembly 104 may be pushed (via the fluid) down the downhole until it is landed on the landing seat 102.

Teeth 216*a* on a lock 214 of the tubular cutting assembly 104 may be coupled to teeth 216*b* disposed in the landing seat 102. Once the teeth 216*a*, 216*b* are coupled, the tubular cutting assembly 104, in some cases, would be inhibited from being uncoupled from the landing seat 102. Thus, back-pressure from below the tubular cutting assembly 104, in some cases, may not cause the tubular cutting assembly 104 to be pushed away from the landing seat 102.

Male socket surfaces 208 of a landing mandrel 106 of the tubular cutting assembly 104 may be aligned with female socket surfaces 202 disposed on the landing seat 102. If the male socket surfaces 208 of the landing mandrel 106 are rotated relative to the female socket surfaces 202 disposed in the landing seat 102, portions of the male socket surfaces 208 would be abutted against portions of the female surfaces 202. Accordingly, the tubular cutting assembly 104 would be inhibited from rotating relative to the landing seat 102. Thus, the tubular cutting assembly 104 may be fixedly coupled to the landing seat 102.

The fluid may be flowed through components of the tubular cutting assembly 104, such as a landing mandrel 106, a disconnect assembly 108, a circulating valve assembly 110, a motor 112, a cutter assembly 114, and a check valve assembly 118 (see arrows in FIGS. 2B, 3A, 4A, 5, 6B-C, and 7A-B). In the motor 112, the fluid may be flowed across the surface of a rotor 506. At the pump down fluid flow rate, pressure exerted against the surface of the rotor 506 by the flowing fluid may cause the rotor 506 to rotate relative to the stator 504. The rotor 506 may be coupled to a drive shaft assembly 508. The drive shaft assembly 508 may be coupled to the cutter assembly 114. Therefore, the cutter assembly 114 may be rotated correspondingly with the rotated rotor 506.

Additionally, the fluid may be flowed against a piston 604 of the cutter assembly 114. The fluid may be flowed through an aperture 620 disposed through the piston 604. Pressure may be exerted on a piston head 616 of the piston 604 from the flow of the fluid under the pump down fluid flow rate. Pressure may be exerted on an insert 628 disposed in the piston head 616 from the flow of the fluid. However, at the pump down fluid flow rate, the pressure exerted on an upper surface of the piston head 616 and insert 628, in some cases, may not be greater than the pressure exerted by a coil against a lower surface of the piston head 616. Therefore, in some cases, the fluid does not push the piston 604 down. However, the fluid may be flowed through the piston 604. The fluid may also be flow through windows 624 disposed in the cutter assembly 114. In some version where the piston is a solid piece, the fluid may be flowed through one or more relief fluid ports 630 disposed through the housing 602 of the cutter assembly 114.

Consequently, the operator may detect an increase in pressure in the fluid because the flow of the fluid is partially inhibited by the pumped down cutting assembly 104 coupled to the landing seat 102. Next, the operator may pump additional fluid down the downhole tubular string at an actuation fluid flow rate that is greater than the pump down fluid flow rate. The actuation fluid flow rate may range from as low as 40, 50, 55, 60, 65 gallons per minute to as high as 70, 75, 80 gallons per minute or higher.

Pumped at the actuation fluid flow rate, the fluid may exert fluid pressure on the upper surface of the piston head 616 and/or insert 628 that is greater than pressure exerted by the coil 606 on the lower surface of the piston head 616. Correspondingly, downward fluid pressure against the piston head 616 and/or insert 628 may cause the piston head 616 to compress the coil 606. Furthermore, the piston 604 may be slid down through the collar 610. A stem 618 of the piston 604 may be abutted against portions of blades 608*a*, 608*b*. Cutting ends 622 of the blades 608*a*, 608*b* may be pivoted outwardly and abutted against the downhole tubular string. The rotating cutter assembly 114 may radially cut, e.g., shear, gouge, or scrape, the inner surface of downhole tubular string.

As the cutter assembly 114 is cutting the downhole tubular string, the fluid may be flowed through the central aperture 620 of the piston 604. The fluid may also be flowed through the windows 624 towards the blades 608*a*, 608*b* and the cut site on the downhole tubular string. The fluid may carry cuttings and/or debris away from the cut site.

In some versions, the fluid may be passed through the relief fluid port 630. The passed fluid may be directed towards the blades 608*a*, 608*b* and the cut site on the downhole tubular string. The fluid may carry cuttings and/or debris away from the cut site.

Also, the operator may apply torque, e.g., rotation, to the downhole tubular string at the surface. In addition, the operator may lift the downhole tubular string at the surface. Lifting the downhole tubular string may stretch a portion of the downhole tubular string, particularly, the portion at or near the cut site. Applying additional distorting force, e.g., torque and/or tension, upon the downhole tubular string may cause it to part or break at or near the cut site.

After the downhole tubular string has been parted, the operator may perform additional downhole operations including cementation, disconnection of the downhole cutting assembly, and/or "fishing". Referring to the views of FIG. 4, the operator may deploy a dart 408 down the downhole tubular string. The operator may deploy the dart in fluid pumped at an actuation fluid flow rate. The dart 408 may be seated on a bypass sleeve 404 of a circulating valve assembly 110. Obstruction of fluid flow through the bypass sleeve 404 by the dart 408 may generate fluid pressure against the upper surfaces of the dart 408 and the bypass sleeve 404. The fluid pressure may cause pins 406 to shear, e.g., snap and/or break. The bypass sleeve may now be slid down the housing 402 of the circulating valve assembly 110.

Additionally, the bypass sleeve 404 may be slid away from bypass fluid ports 410. Thus, fluid may be flowed through the bypass fluid ports 410 into the wellbore below.

In some cases, the operator may need to disconnect a portion of a tubular cutting assembly 104 stuck downhole. Thus, the operator may deploy a dart 301 down the downhole tubular string. The operator may deploy the dart in fluid pumped at an actuation fluid flow rate. The dart 301 may be seated on a lock sleeve 306 of a disconnect assembly 108. Obstruction of fluid flow through the lock sleeve 306 by the dart 301 may generate fluid pressure against the upper surfaces of the dart 301 and the lock sleeve 306. The fluid pressure may cause pins 310 to shear, e.g., snap and/or break. Once the pins 310 are sheared, the lock sleeve 306 may now be slid down an upper housing 302 and a lower housing 304 of the disconnect assembly 108. A release groove 316 disposed on an outer surface of the lock sleeve 306 may be aligned with lugs 318. Also, the lock sleeve 306 may be slid away from bypass fluid ports 308. Thus, the fluid may be flowed through the bypass fluid ports 308 into the wellbore.

At this point, the upper housing 302 and the lower housing 304 may still be coupled. However, fluid pressure above the dart 301 may have decreased because the fluid may be flowed through the bypass fluid ports 308. The operator may detect the decrease in fluid pressure to indicate that the disconnect assembly 108 is unlocked and can be uncoupled.

The operator may pull up on the drill string and cause the upper housing 302 of the disconnect assembly 108 to slide up relative to the lower housing 304. A tapered end 320 of each lug 318 may be abutted against a surface defining a locking groove 322. Pulling the upper housing 302 upward may cause the surface defining the locking groove 322 to push the lug out of the locking groove 322. Simultaneously, portions of the lugs 318 may be slid into the release groove 316. The operator may continue pulling on the drill string to decouple the upper housing 302 from the lower housing 304.

What is claimed as the invention is:

1. A method of cutting a downhole tubular string, comprising:

providing a downhole cutting assembly that comprises:
- a landing mandrel;
- a motor disposed below the landing mandrel;
- a housing rotatably coupled to the motor; and
- a blade pivotably coupled to the housing, the blade having a portion capable of being abutted against the downhole tubular string;

positioning a landing seat in a wellbore, wherein the landing seat is disposed on the downhole tubular string;

deploying the downhole cutting assembly in the downhole tubular string after the landing seat is positioned in the wellbore;

coupling the landing mandrel to the landing seat positioned in the wellbore;

pumping fluid into the downhole tubular string at an actuation flow rate;

pushing a piston against a portion of the blade;

abutting a cutting end of the blade against an inner surface of the downhole tubular string; and rotating the blade around a central axis of the downhole tubular string.

2. The method of claim 1, further comprising passing fluid through a window disposed through the housing of the downhole cutting assembly towards the blade.

3. The method of claim 1, further comprising passing fluid through a relief fluid port disposed through the housing of the downhole cutting assembly towards the blade.

4. The method of claim 1, further comprising lifting the downhole tubular string.

5. The method of claim 1, further comprising rotating the downhole tubular string.

6. The method of claim 1, further comprising coupling a lock disposed on the landing mandrel with the landing seat positioned in the wellbore.

7. The method of claim 1, further comprising biasing a flapper of a check valve assembly to an open position with fluid flowing downward from above the check valve assembly.

8. The method of claim 1, further comprising inhibiting fluid below a check valve assembly from egress therethrough, wherein a flapper of the check valve assembly may be disposed in a closed position.

9. The method of claim 1, further comprising stretching the downhole tubular string.

10. The method of claim 1, further comprising applying torque to the downhole tubular string.

11. The method of claim 1, further comprising aligning outer socket surfaces of the landing mandrel with inner socket surfaces of the landing seat positioned in the wellbore.

12. The method of claim 1, further comprising abutting outer socket surfaces of the landing mandrel against inner socket surfaces of the landing seat positioned in the wellbore.

13. The method of claim 1, further comprising inhibiting rotation of the landing mandrel with the landing seat positioned in the wellbore.

14. The method of claim 1, further comprising abutting a lock disposed on the landing mandrel against the landing seat positioned in the wellbore.

15. The method of claim 1, further comprising cutting the downhole tubular string with the cutting end of the blade.

16. The method of claim 1, further comprising uncoupling the landing mandrel from the landing seat positioned in the wellbore.

17. A method of cutting a downhole tubular string, comprising:

providing a downhole cutting assembly that comprises:
- a landing mandrel;
- a motor disposed below the landing mandrel;
- a housing rotatably coupled to the motor; and
- a blade pivotably coupled to the housing, the blade having a portion capable of being abutted against the downhole tubular string;

coupling a landing seat to the downhole tubular string;

positioning the landing seat in a wellbore using the downhole tubular string;

deploying the downhole cutting assembly in the downhole tubular string after the landing seat is positioned in the wellbore;

coupling the landing mandrel to the landing seat positioned in the wellbore;

pumping fluid through the landing seat, the landing mandrel, the motor, and the housing;

pushing a piston against a portion of the blade;

abutting a cutting end of the blade against an inner surface of the downhole tubular string; and rotating the blade around a central axis of the downhole tubular string.

18. The method of claim 17, further comprising aligning outer socket surfaces of the landing mandrel with inner socket surfaces of the landing seat positioned in the wellbore.

19. The method of claim 17, further comprising abutting outer socket surfaces of the landing mandrel against inner socket surfaces of the landing seat positioned in the wellbore.

20. The method of claim 17, further comprising abutting a lock disposed on the landing mandrel against the landing seat positioned in the wellbore.

* * * * *